US011525253B2

(12) United States Patent
Tamura et al.

(10) Patent No.: US 11,525,253 B2
(45) Date of Patent: Dec. 13, 2022

(54) PRIVATE PART CLEANING DEVICE AND TOILET

(71) Applicant: LIXIL Corporation, Tokyo (JP)

(72) Inventors: Hideki Tamura, Tokyo (JP); Shinichi Gomita, Tokyo (JP); Kojiro Watari, Tokyo (JP)

(73) Assignee: LIXIL Corporation, Tokyo (JP)

( * ) Notice: Subject to any disclaimer, the term of this patent is extended or adjusted under 35 U.S.C. 154(b) by 323 days.

(21) Appl. No.: 17/041,418

(22) PCT Filed: Mar. 19, 2019

(86) PCT No.: PCT/JP2019/011360
§ 371 (c)(1),
(2) Date: Sep. 24, 2020

(87) PCT Pub. No.: WO2019/188555
PCT Pub. Date: Oct. 3, 2019

(65) Prior Publication Data

US 2021/0040720 A1 Feb. 11, 2021

(30) Foreign Application Priority Data

Mar. 27, 2018 (JP) ..... JP2018-059558
Mar. 27, 2018 (JP) ..... JP2018-059559
Mar. 27, 2018 (JP) ..... JP2018-059560

(51) Int. Cl.
*E03D 9/08* (2006.01)
*E03D 9/00* (2006.01)

(52) U.S. Cl.
CPC ..... *E03D 9/08* (2013.01); *E03D 9/002* (2013.01)

(58) Field of Classification Search
CPC ..... E03D 9/002; E03D 9/08
USPC ..... 4/420.5
See application file for complete search history.

(56) References Cited

FOREIGN PATENT DOCUMENTS

| | | | |
|---|---|---|---|
| JP | H7-23075 | U | 4/1995 |
| JP | 2002-364055 | A | 12/2002 |
| JP | 2008-266879 | A | 11/2008 |
| JP | 2011-38250 | A | 2/2011 |
| JP | 2014-173322 | A | 9/2014 |
| JP | 2016-44413 | A | 4/2016 |
| JP | 2016-217101 | A | 12/2016 |
| JP | 2017-14703 | A | 1/2017 |
| KR | 10-2010-0047082 | A | 5/2010 |

*Primary Examiner* — Christine J Skubinna
(74) *Attorney, Agent, or Firm* — Morrison & Foerster LLP

(57) ABSTRACT

A first cleaning nozzle and a second cleaning nozzle configured to be capable of being advanced and retracted and perform private part cleaning on a human body in an advanced state; a shutter configured to open and close an opening through which the first cleaning nozzle and the second cleaning nozzle are advanced and retracted; and a shutter water film forming portion configured to supply water to a front surface of a shutter main body of the shutter to form a water film are provided.

20 Claims, 14 Drawing Sheets

PRIVATE PART CLEANING DEVICE AND TOILET

CROSS-REFERENCE TO RELATED APPLICATIONS

This application is a national stage application under 35 USC 371 of International Application No. PCT/JP2019/011360, filed Mar. 19, 2019, which claims the priority of Japanese Application No. 2018-059558, filed Mar. 27, 2018, Japanese Application No. 2018-059559, filed Mar. 27, 2018, and Japanese Application No. 2018-059560, filed Mar. 27, 2018, the entire contents of each of which are incorporated herein by reference.

FIELD OF THE DISCLOSURE

The present disclosure relates to a private part cleaning device and a toilet.

BACKGROUND OF THE DISCLOSURE

Private part cleaning devices which clean the private part of users who sit on toilet seats are known. Cleaning nozzles of private part cleaning devices are configured to be moved obliquely downward and forward in toilet bowls at the time of private part cleaning and retracted if the private part cleaning is completed. Patent Document 1 describes a private part cleaning device in which a shutter configured to open and close an opening through which a cleaning nozzle is advanced and retracted is provided in the opening and a discharge port through which a liquid is discharged toward a distal end portion of the cleaning nozzle is provided on a surface of the shutter on a cleaning nozzle side.

The private part cleaning device is configured to clean the distal end portion of the cleaning nozzle by a liquid discharged through the discharge port of the shutter.

Patent Document 1: Japanese Unexamined Patent Application, First Publication No. 2014-173322

SUMMARY OF THE DISCLOSURE

The shutter of the above-described private part cleaning device is always exposed. As a result, sewage or filth may adhere to the shutter at the time of using a toilet to contaminate the shutter in some cases.

For this reason, a private part cleaning device capable of cleaning a shutter is desired. Particularly, a front surface of the shutter which is located on a toilet bowl side and opposite to a surface on a cleaning nozzle side is always exposed in a toilet bowl. For this reason, a private part cleaning device capable of cleaning the front surface of the shutter is desired.

In addition, a private part cleaning device capable of cleaning a shutter in addition to a cleaning nozzle is desired.

Therefore, an advantage of the present disclosure is to provide a private part cleaning device capable of cleaning a shutter.

One advantage of the present disclosure is to provide a private part cleaning device capable of cleaning a shutter and a cleaning nozzle.

Another advantage of the present disclosure is to provide a private part cleaning device and a toilet capable of preventing sewage and filth from adhering to a shutter at the time of using the toilet.

A private part cleaning device some embodiments of the present disclosure is a private part cleaning device which includes: a cleaning nozzle configured to be capable of being advanced and retracted and perform private part cleaning on a human body in a advanced state; a shutter configured to open and close an opening through which the cleaning nozzle is advanced and retracted; and a water film forming portion configured to supply water to a front surface of the shutter to form a water film.

According to the present disclosure, since the water film forming portion configured to form a water film by supplying water to the front surface of the shutter is provided, the front surface of the shutter is capable of being cleaned by the water film formed on the front surface of the shutter and it is capable of preventing contaminants from adhering to the front surface of the shutter.

The front surface of the shutter is a surface of the shutter on a side of the cleaning nozzle advancing direction and the front surface is a surface on a side opposite to a side thereof facing the cleaning nozzle being retracted state.

The water film may refer to water which spreads and flows in a film shape with a predetermined thickness. The water film formed on the front surface of the shutter may refer to water which spreads and flows in a film shape on the front surface of the shutter.

In a private part cleaning device some embodiments of the present disclosure, the water film forming portion may have a plurality of water ejection ports through which water is ejected to the front surface of the shutter, and the plurality of water ejection ports may be arranged at intervals along an upper edge portion of the front surface of the shutter.

With such an arrangement, since water ejected through the plurality of water ejection ports flows along the entire front surface of the shutter, a water film is capable of being formed over the entire front surface of the shutter. For this reason, the entire front surface of the shutter is capable of being cleaned and it is capable of preventing contaminants from adhering to the entire front surface of the shutter.

In a private part cleaning device some embodiments of the present disclosure, the water film forming portion may have a water flowing portion in which water flowing toward the plurality of water ejection ports flows and which is connected to each of the plurality of water ejection ports, the plurality of water ejection ports may be arranged at intervals in a water flow direction of the water flowing portion, and the plurality of water ejection ports may be set such that an inner diameter of the water ejection ports arranged on a downstream side becomes increasingly gradually larger than an inner diameter of the water ejection ports arranged on an upstream side.

With such an arrangement, it is capable of securing a flow rate of water to be ejected through the water ejection ports connected to the downstream side of the water flowing portions which are lower water pressure, a uniform flow rate of water to be ejected through the plurality of water ejection ports is capable of being maintained, and a uniform water film is capable of being formed over the entire front surface of the shutter.

In a private part cleaning device some embodiments of the present disclosure, a protrusion wall protruding forward may be formed on an outer edge portion of the front surface of the shutter.

With such an arrangement, since water supplied to the front surface of the shutter from the water film forming portion hits the protrusion wall, the water is prevented from flowing down from the shutter before the water crosses the front surface of the shutter and is reliably guided below the shutter. As a result, a water film is capable of being formed on the front surface of the shutter.

In a private part cleaning device some embodiments of the present disclosure, the water film forming portion may be configured to supply water to the shutter when a user uses the toilet.

In the present disclosure, since the water film forming portion is configured to supply water to the shutter and form a water film on the shutter if the user uses the toilet, it is capable of preventing sewage and filth from adhering to the shutter at the time of using the toilet by a water film formed on the shutter.

In a private part cleaning device some embodiments of the present disclosure, the water film forming portion may be configured to supply water to the shutter in a state in which the cleaning nozzle is advanced.

With such an arrangement, since a water film is formed on the shutter when being used the toilet in which the cleaning nozzle has been advanced, it is capable of preventing sewage and filth from adhering to the shutter at the time of using the toilet by the water film formed on the shutter.

In a private part cleaning device some embodiments of the present disclosure, the water film forming portion may supply water to the shutter during a period in which the cleaning nozzle is advanced and performs a private part cleaning operation.

With such an arrangement, a water film is capable of being formed on the shutter during the private part cleaning. For this reason, even if cleaning water for private part cleaning hits the user or the toilet and is splashed toward the shutter, it is capable of preventing adhering of the splashed cleaning water to the shutter by a water film formed on the shutter.

In a private part cleaning device some embodiments of the present disclosure, the water film forming portion may supply water to the shutter also after the advanced cleaning nozzle retracted of the opening.

With such an arrangement, it is capable of preventing contaminants from adhering to the shutter also after the cleaning nozzle has retracted to the rearward of the opening. In addition, when contaminants adhere to the shutter, it is capable of washing off the adhered contaminants.

In a private part cleaning device some embodiments of the present disclosure, the private part cleaning device may include: a detection unit capable of detecting that a user is using the toilet, wherein the water film forming portion may be configured to supply water to the shutter if the detection unit detects a user.

With such an arrangement, it is capable of preventing sewage and filth from adhering to the shutter by forming a water film on the shutter at the time of using the toilet.

Furthermore, also when the user does not use the cleaning nozzle, it is capable of preventing sewage and filth from adhering to the shutter at the time of using the toilet.

In a private part cleaning device some embodiments of the present disclosure, the detection unit may be capable of detecting a user who has entered a region in which the toilet is provided, and the water film forming portion may be configured to supply water to the shutter if the detection unit detects a user.

With such an arrangement, it is capable of preventing sewage and filth from adhering to the shutter by forming a water film on the shutter at the time of using the toilet. Furthermore, also when the user does not use the cleaning nozzle, it is capable of preventing sewage and filth from adhering to the shutter at the time of using the toilet.

In a private part cleaning device some embodiments of the present disclosure, the detection unit may be capable of detecting a sitting state of the user who sits on a toilet seat of the toilet, and the water film forming portion may be configured to supply water to the shutter if the detection unit detects the sitting state of the user.

With such an arrangement, it is capable of preventing sewage and filth from adhering to the shutter by forming a water film on the shutter at the time of using the toilet. Furthermore, also when the user does not use the cleaning nozzle, it is capable of preventing sewage and filth from adhering to the shutter at the time of using the toilet.

In a private part cleaning device some embodiments of the present disclosure, the detection unit may be capable of detecting a standing state of the user who stands on a side in front of the toilet, and the water film forming portion may be configured to supply water to the shutter if the detection unit detects this standing state of the user.

With such an arrangement, it is capable of preventing sewage and filth from adhering to the shutter by forming a water film on the shutter at the time of using the toilet. Furthermore, also when the user stands and urinates in a state in which the cleaning nozzle is not used, it is capable of preventing sewage and filth from adhering to the shutter.

In a private part cleaning device some embodiments of the present disclosure, the water film forming portion may be configured to perform a private part cleaning operation by advancing the cleaning nozzle after the detection unit detects a user, and water may be supplied to the cleaning nozzle in which the private part cleaning operation has been completed before it is retracted, and the shutter is configured to close the opening.

With such an arrangement, it is capable of preventing sewage and filth from adhering to the shutter by forming a water film on the shutter at the time of using the toilet.

In a private part cleaning device some embodiments of the present disclosure, the water film forming portion may supply water to the shutter and cause the water supplied to the shutter to flow into the cleaning nozzle.

According to the present disclosure, since the water film forming portion is capable of supplying water to the shutter, the shutter is capable of cleaning by the water supplied to the shutter, and it is capable of preventing contaminants from adhering to the shutter. Since the water supplied to the shutter flows to the cleaning nozzle, the cleaning nozzle is capable of being cleaned by the water and it is capable of preventing contaminants from adhering to the cleaning nozzle.

In a private part cleaning device some embodiments of the present disclosure, the private part cleaning device may include: a guide portion configured to guide the water supplied to the shutter into the cleaning nozzle.

With such an arrangement, water supplied to the shutter is capable of being guided to the cleaning nozzle.

In a private part cleaning device some embodiments of the present disclosure, the guide portion may be a protrusion wall protruding from a surface of the shutter to which water is supplied from the water film forming portion, and the protrusion wall may be formed on an outer edge portion of the surface to which the water is supplied from the water film forming portion and may be notched on an side above of the cleaning nozzle.

With such an arrangement, water supplied to the shutter is capable of being flowed along the protrusion wall without spilling of the water from the shutter to the outside and the water is capable of being guided to the cleaning nozzle by flowing the water downward from a notched portion of the protrusion wall.

Some embodiments of the present disclosure include a toilet which includes a private part cleaning device, wherein the private part cleaning device includes: a cleaning nozzle configured to be capable of being advanced and retracted through an opening and perform private part cleaning on a human body in a state in which the cleaning nozzle is advanced and retracted through the opening; a shutter configured to open and close the opening; and a water film forming portion configured to supply water to the shutter to form a water film, wherein the water film forming portion is configured to supply water to the shutter when a user uses the toilet.

According to the present disclosure, a water film is capable of being formed on a front surface of a shutter to clean the front surface of the shutter.

According to the present disclosure, it is capable of preventing sewage and filth from adhering to a shutter at the time of using a toilet.

According to the present disclosure, a shutter and a cleaning nozzle is capable of being cleaned.

DETAILED DESCRIPTION OF THE DISCLOSURE

A private part cleaning device and a toilet according to some embodiments of the present disclosure will be described below with reference to FIGS. 1 to 14.

Figure 1:
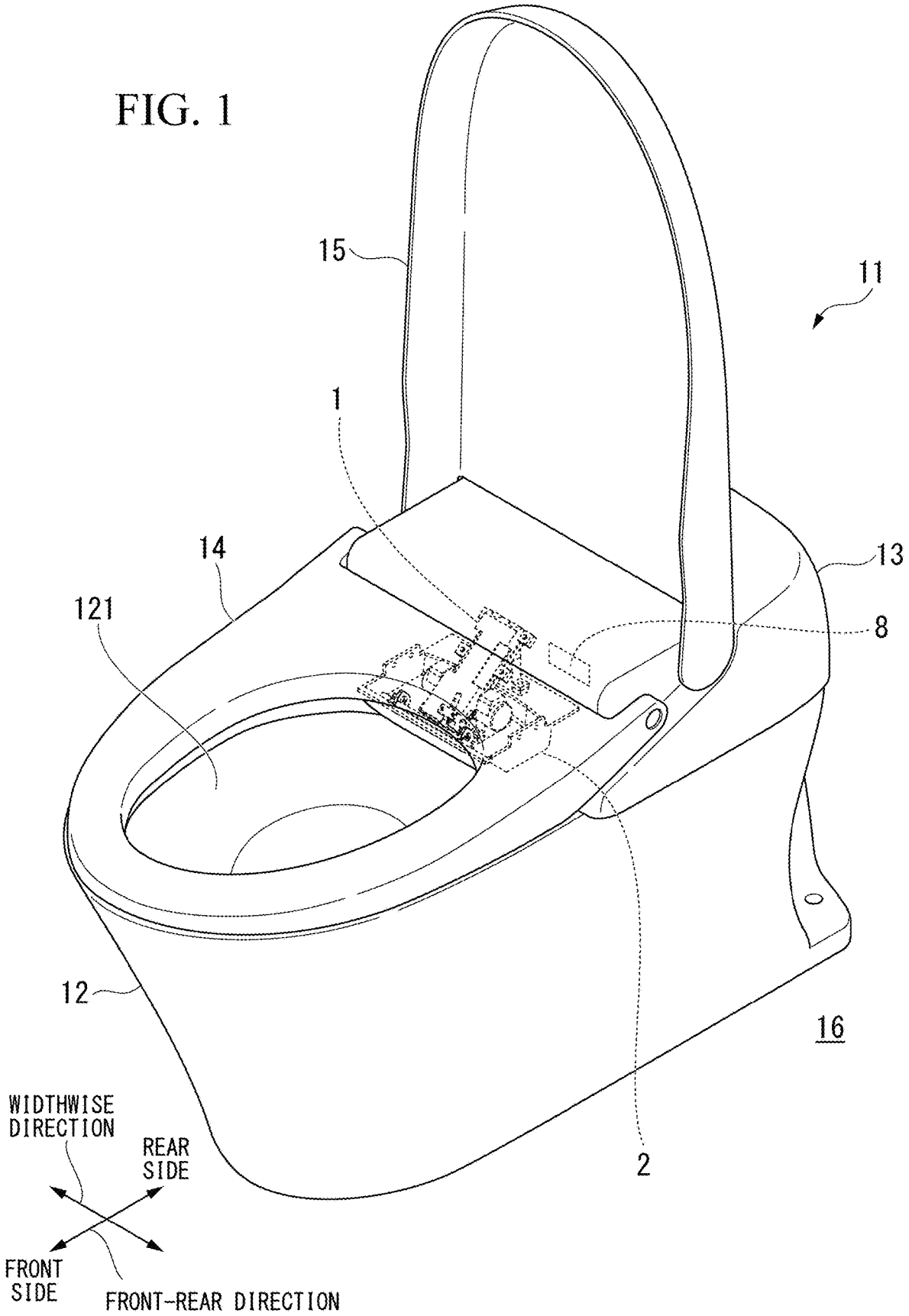
FIG. 1 is a perspective view illustrating an example of a toilet according to some embodiments.

As illustrated in FIG. 1, a private part cleaning device 1 according to some embodiments of the present disclosure is provided in a toilet 11. The toilet 11 includes a toilet main body 12, a functional unit 13, a toilet seat 14, and a toilet lid 15. The functional unit 13 is attached to the toilet main body 12. The toilet seat 14 and the toilet lid 15 are attached to the toilet main body 12 via the functional unit 13.

A toilet bowl 121 is formed in the toilet main body 12. The toilet main body 12 is configured to be installed on a floor surface 16 and connected to a drainage pipe (not shown).

The functional unit 13 includes the private part cleaning device 1 configured to perform private part cleaning and a case 2 configured to accommodate the private part cleaning device 1. The functional unit 13 may include a warm air drying device (not shown) configured to perform warm air drying, a deodorizing device (not shown) configured to perform deodorizing, a power supply device (not shown) configured to supply electric power to these devices, and the like as necessary, in addition to the private part cleaning device 1. A device provided in the functional unit 13 is accommodated in the case 2 and covered with the case 2 such that it is not exposed to the outside.

Figure 2:
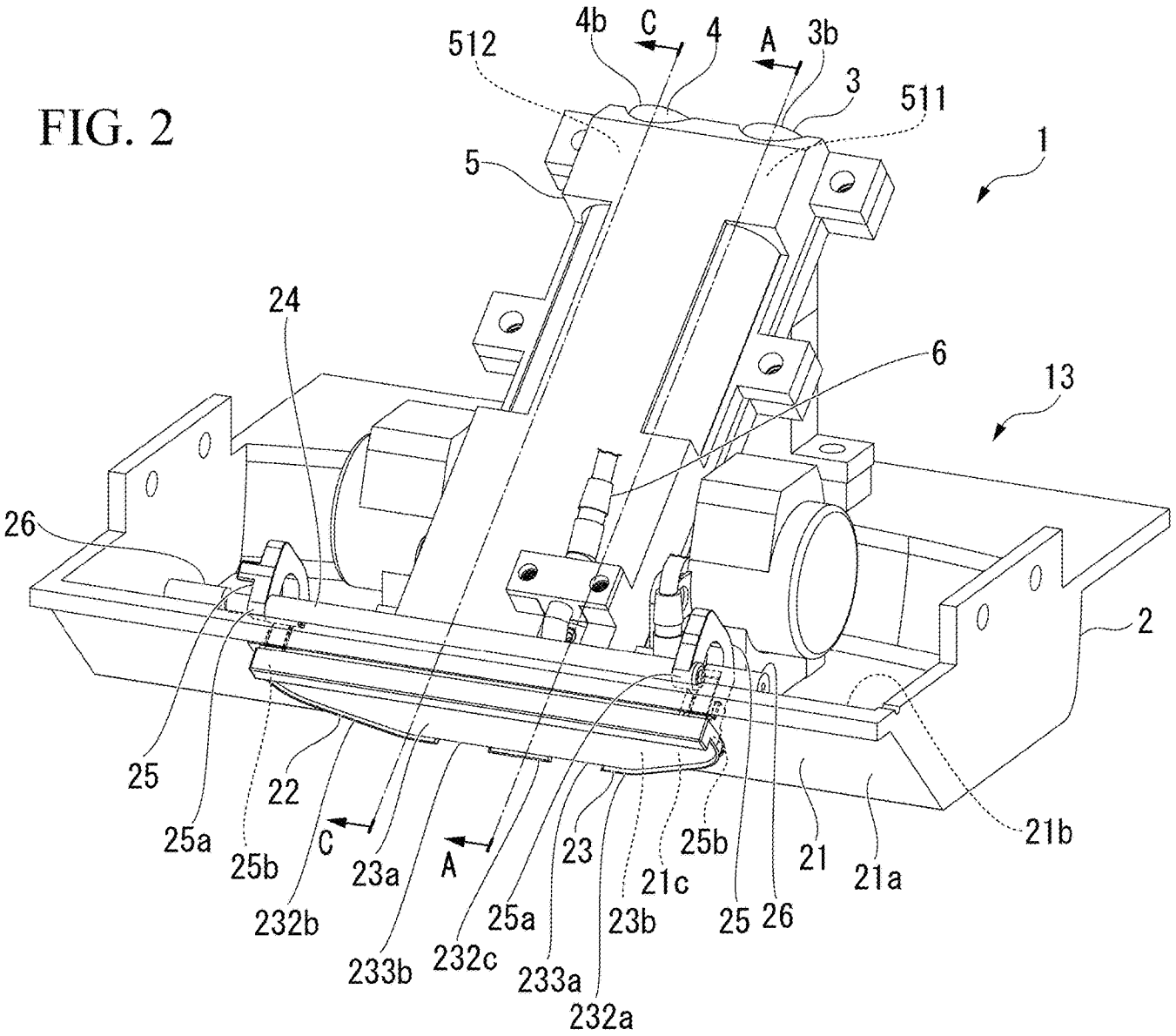
FIG. 2 is a perspective view illustrating an example of a private part cleaning device and a diagram illustrating a state in which a first cleaning nozzle is retracted according to some embodiments.
Figure 3:
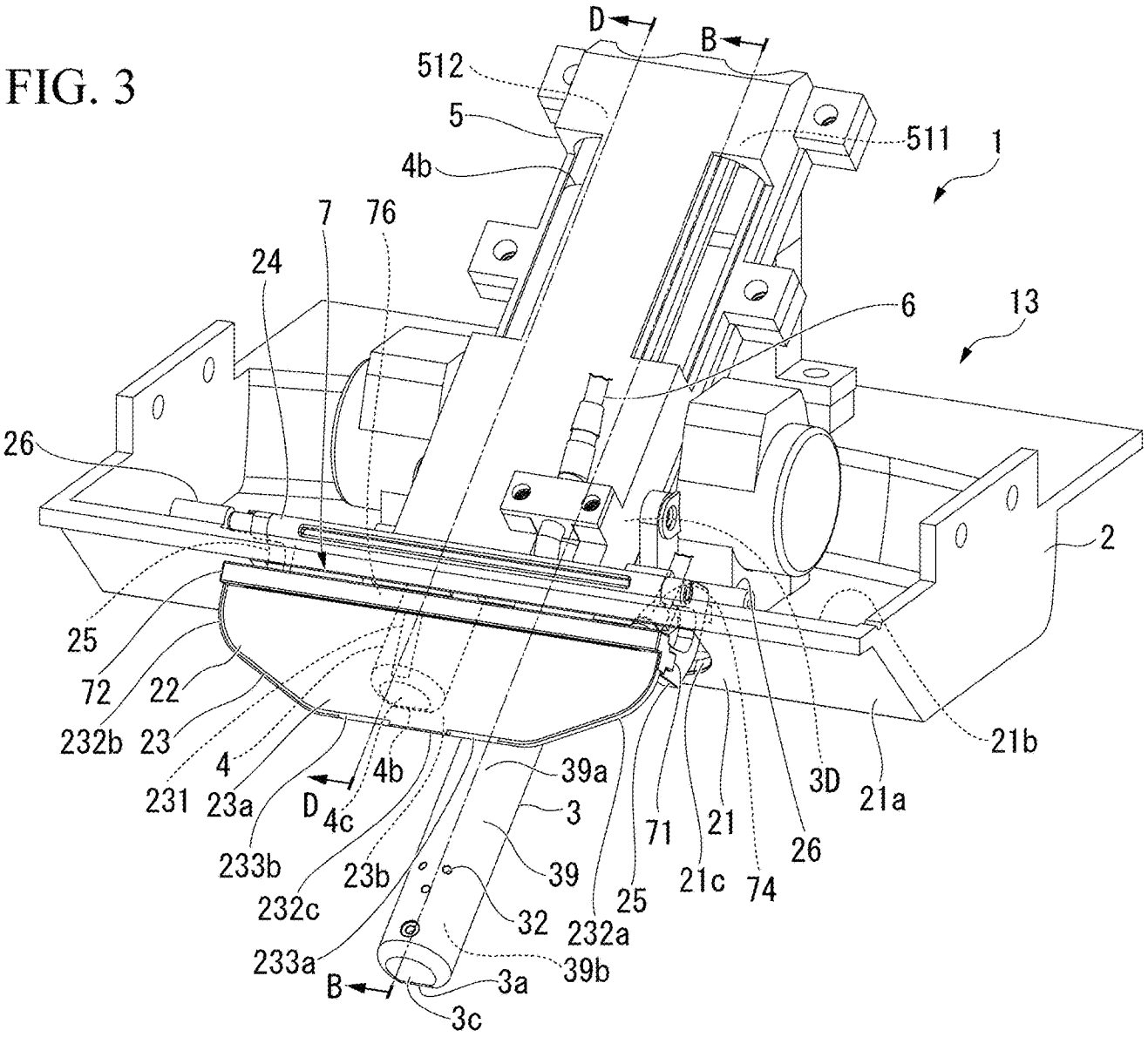
FIG. 3 is a perspective view illustrating an example of the private part cleaning device and a diagram illustrating a state in which the first cleaning nozzle is retracted according to some embodiments.

As illustrated in FIGS. 2 and 3, a part of the case 2 of the functional unit 13 disposed in front of the private part cleaning device 1 is referred to as a "front plate part 21." The front plate part 21 is arranged such that a plate surface thereof is oriented in an oblique direction in which the plate surface gradually extends rearward from a front end toward a lower end side. The oblique direction of in which the plate surface of the front plate part 21 is directed is substantially the same as a direction in which a first cleaning nozzle 3 and a second cleaning nozzle 4 of the private part cleaning device 1 which will be described later advance and retract.

In the front plate part 21, a surface which faces the inside of the toilet bowl 121 (refer to FIG. 1) is referred to as a "front surface 21*a*" and a surface opposite to the front surface 21*a* and faces to the private part cleaning device 1 is referred to as a "rear surface 21*b*."

An opening 21*c* passing through a plate surface is formed at a substantially central portion of the front plate part 21 in a width direction thereof. The opening 21*c* has a shape in which an opening dimension thereof in a width direction is longer than an opening dimension thereof in an upward-downward direction. The opening 21*c* is configured such that the first cleaning nozzle 3 and the second cleaning nozzle 4 of the private part cleaning device 1 pass through the opening 21*c*.

The functional unit 13 is attached to the rear side of the toilet main body 12 when viewed from a side of a user who uses the toilet 11. The toilet bowl 121 is arranged on the front side of the toilet main body 12. A side on which the functional unit 13 is attached to the toilet main body 12 is referred to as a "rear side", the opposite side of the rear side is referred to as a "front side", and a direction connecting the front side and the rear side is referred to as a "forward-rearward direction". A horizontal direction orthogonal to the forward-rearward direction is referred to as a "width direction".

As illustrated in FIGS. 2 and 3, the private part cleaning device 1 includes the first cleaning nozzle 3 (a cleaning nozzle) for cleaning the anus, the second cleaning nozzle 4 (a cleaning nozzle) for a bidet, a supporter 5, a private part cleaning warm water supply portion (not shown), a first cleaning nozzle water film forming portion 6, a shutter 22, a shutter water film forming portion (a water supply portion) 7, and a control unit (not shown). The supporter 5 supports the first cleaning nozzle 3 and the second cleaning nozzle 4. The private part cleaning warm water supply portion supplies warm water for private part cleaning to the first cleaning nozzle 3 and the second cleaning nozzle 4. The first cleaning nozzle water film forming portion 6 supplies water to an outer circumferential surface 39 (refer to FIG. 3) of the first cleaning nozzle 3 to form a water film on the outer circumferential surface 39 and a front end surface 3*c* of the first cleaning nozzle 3. The shutter 22 is capable of opening and closing the opening 21*c* of the case 2 through rotation. The shutter water film forming portion 7 supplies water to a front surface 23*a* of a shutter main body 23 of the shutter 22 to form a water film. The control unit controls private part cleaning and the formation of a water film by the first cleaning nozzle water film forming portion 6 and the shutter water film forming portion 7.

The water film refers to water which spreads and flows in a film shape with a predetermined thickness. The water film formed on the front surface 23*a* of the shutter main body 23 refers to water which spreads and flows in a film shape on the front surface 23*a* of the shutter main body 23. The water film formed on the outer circumferential surface 39 of the first cleaning nozzle 3 refers to water which spreads and flows in a film shape on the outer circumferential surface 39 of the first cleaning nozzle 3.

The private part cleaning device 1 is arranged at a substantially central part of the functional unit 13 in the width direction thereof (refer to FIG. 1).

As illustrated in FIGS. 2 to 5, each of the first cleaning nozzle 3 and the second cleaning nozzle 4 is formed in a round bar shape having a substantially circular cross-sectional shape. The first cleaning nozzle 3 and the second cleaning nozzle 4 are arranged such that a direction (a length direction) in which the first cleaning nozzle 3 and the second cleaning nozzle 4 extend is an oblique direction in which the first cleaning nozzle 3 and the second cleaning nozzle 4 are gradually directed downward toward the front side. The first cleaning nozzle 3 and the second cleaning nozzle 4 are arranged parallel to each other in the width direction so that the first cleaning nozzle 3 is located on one side in the width direction and the second cleaning nozzle 4 is located on the other side in the width direction.

Front and lower end portions of the first cleaning nozzle 3 and the second cleaning nozzle 4 in a state in which the first cleaning nozzle 3 and the second cleaning nozzle 4 are arranged as described above are referred to as "front end parts 3*a* and 4*a* (refer to FIGS. 3 to 5)" and rear and upper end portions thereof are referred to as "rear end part 3*b* and 4*b*." The outer circumferential surface 39 of the first cleaning nozzle 3 refers to a surface connecting the front end parts 3*a* of the first cleaning nozzle 3 with the rear end part 3*b* and along a surface of the first cleaning nozzle 3 in a length direction (an axial direction) thereof.

Figure 5:
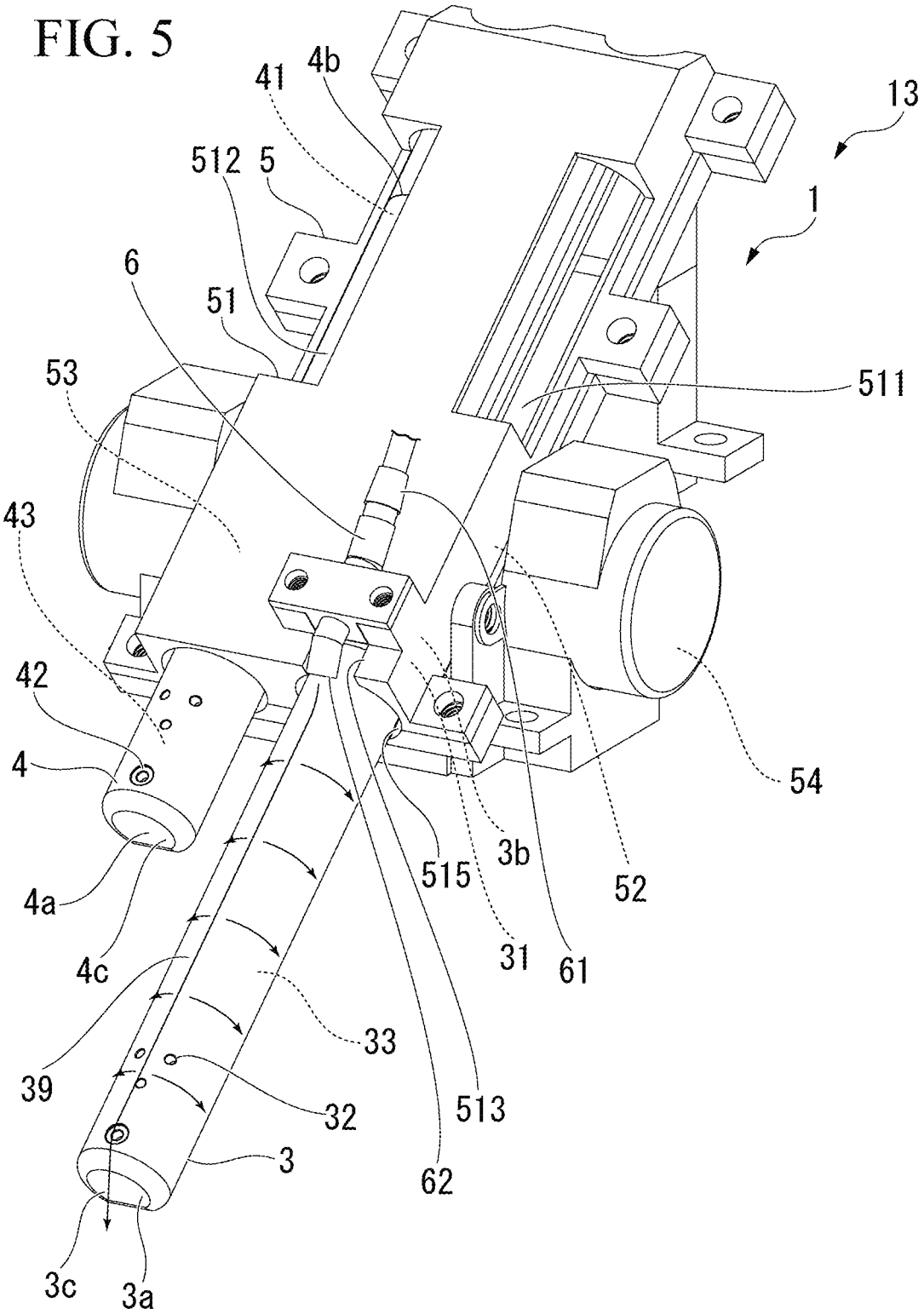
FIG. 5 is a perspective view in which the case of FIG. 3 is omitted according to some embodiments.

As illustrated in FIG. 5, the first cleaning nozzle 3 includes a water supply port 31, a cleaning water discharge outlet 32, and a water flowing pipe 33. The water supply port 31 is provided in the vicinity of the rear end part 3*b* and warm water for private part cleaning is supplied to the water supply port 31. The cleaning water discharge outlet 32 is provided in the vicinity of the front end part 3*a* and warm water for private part cleaning is ejected through the cleaning water discharge outlet 32. The water flowing pipe 33 is provided inside the first cleaning nozzle 3, connects the water supply port 31 to the cleaning water discharge outlet 32, and has warm water flowing therein. The cleaning water discharge outlet 32 opens in an oblique direction upward and forward and the cleaning water discharge outlet 32 is configured to be capable of ejecting warm water for private part cleaning upward and forward in an oblique direction.

The front end surface 3*c* of the first cleaning nozzle 3 is formed in a planar shape in which the front end surface 3*c* is orthogonal to an oblique direction (a length direction) in which the first cleaning nozzle 3 extends.

Figure 6:
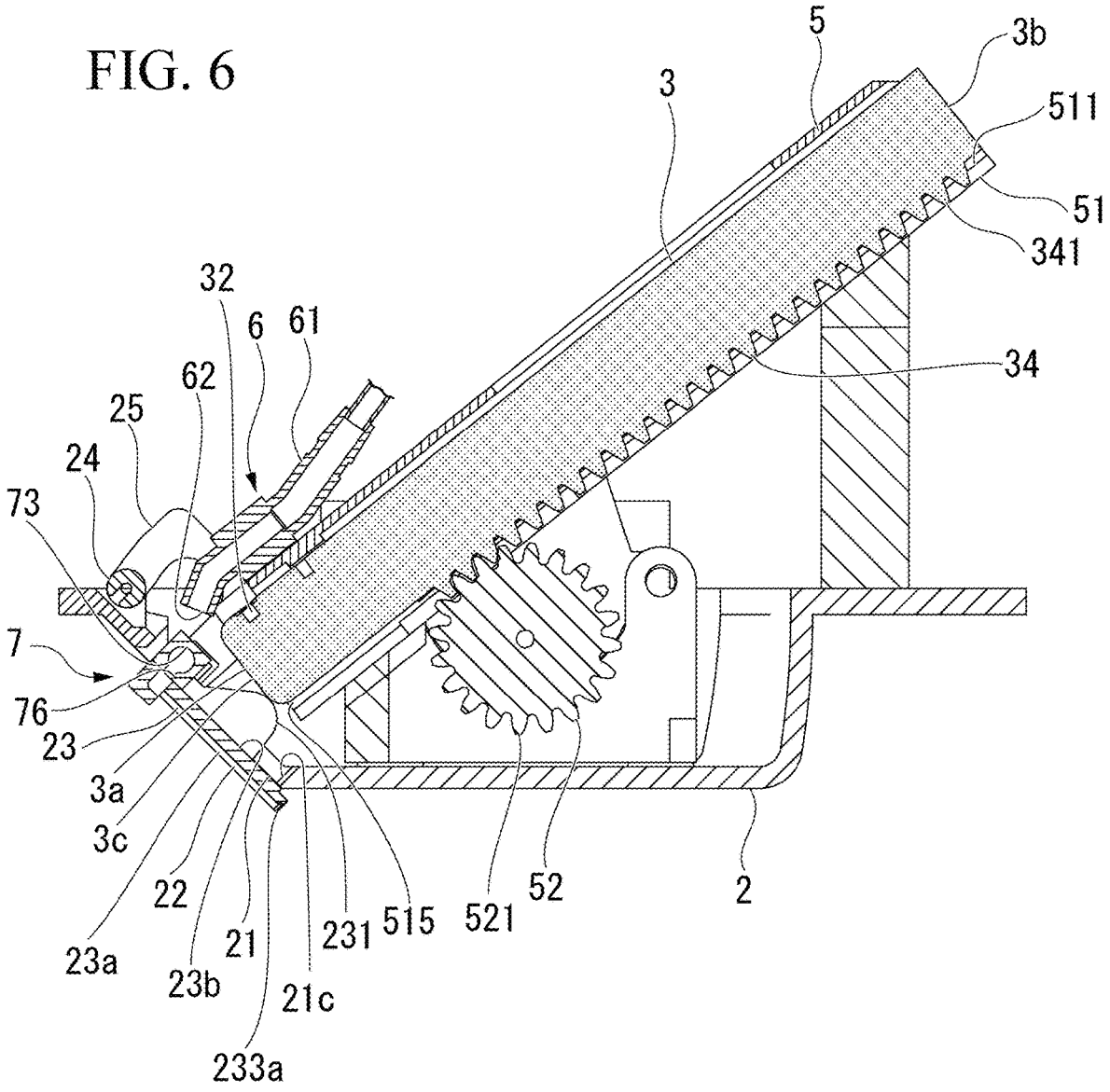
FIG. 6 is a cross-sectional view taken along line A-A of FIG. 2 according to some embodiments.
Figure 7:
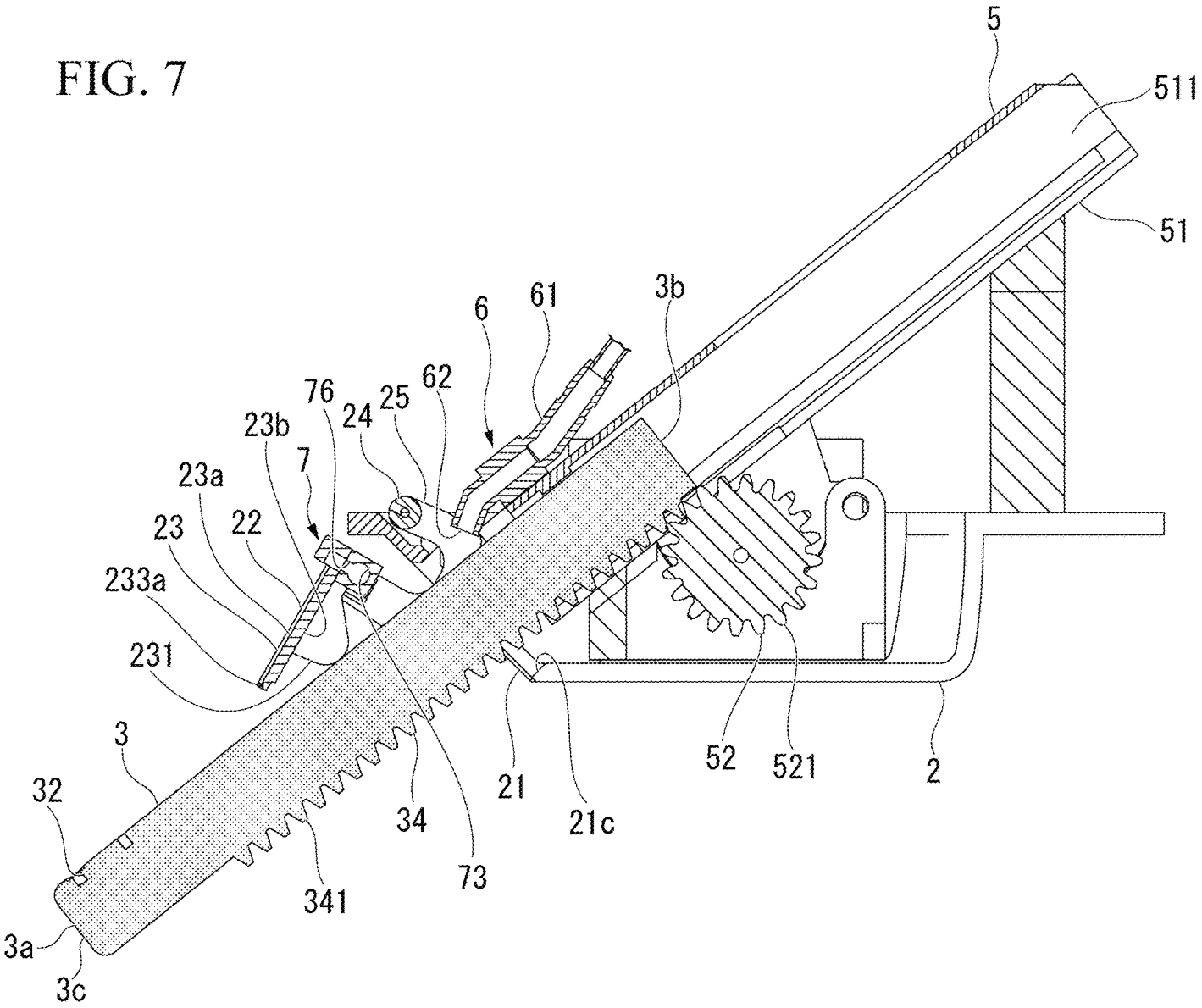
FIG. 7 is a cross-sectional view taken along line B-B of FIG. 3 according to some embodiments.

As illustrated in FIGS. 6 and 7, a first rack (a gear) 34 is provided lower side of the first cleaning nozzle 3. The first rack 34 is provided in the length direction of the first cleaning nozzle 3. In the first rack 34, a plurality of teeth 341 protruding downward are arranged in the length direction of the first cleaning nozzle 3.

The first rack 34 is not provided in the vicinity of the front end part 3*a* of the first cleaning nozzle 3 and the first rack 34 is provided in a range from an intermediate part where is behind the front end part 3*a* with a slight distance in the length direction to the rear end part 3*b* in the first cleaning nozzle 3.

As illustrated in FIG. 5, the second cleaning nozzle 4 includes the water supply port 41, the cleaning water discharge outlet 42, and the water flowing pipe 43. The water supply port 41 is provided in the vicinity of the rear end part 4*b* and warm water for private part cleaning is supplied to the water supply port 41. The cleaning water discharge outlet 42 is provided in vicinity of the front end part 4*a* and warm water for private part cleaning is ejected through the cleaning water discharge outlet 42. The water flowing pipe 43 is provided inside the second cleaning nozzle 4, connects the water supply port 41 with the cleaning water discharge outlet 42, and has warm water flowing therein. The cleaning water discharge outlet 42 opens in an oblique direction upward and forward and the cleaning water discharge outlet 42 is configured to be capable of ejecting warm water for private part cleaning in an oblique direction upward and forward.

A front end surface 4*c* of the second cleaning nozzle 4 is formed in a planar shape in which the front end surface 4*c* is orthogonal to an oblique direction (a length direction) in which the second cleaning nozzle 4 extends.

Figure 8:
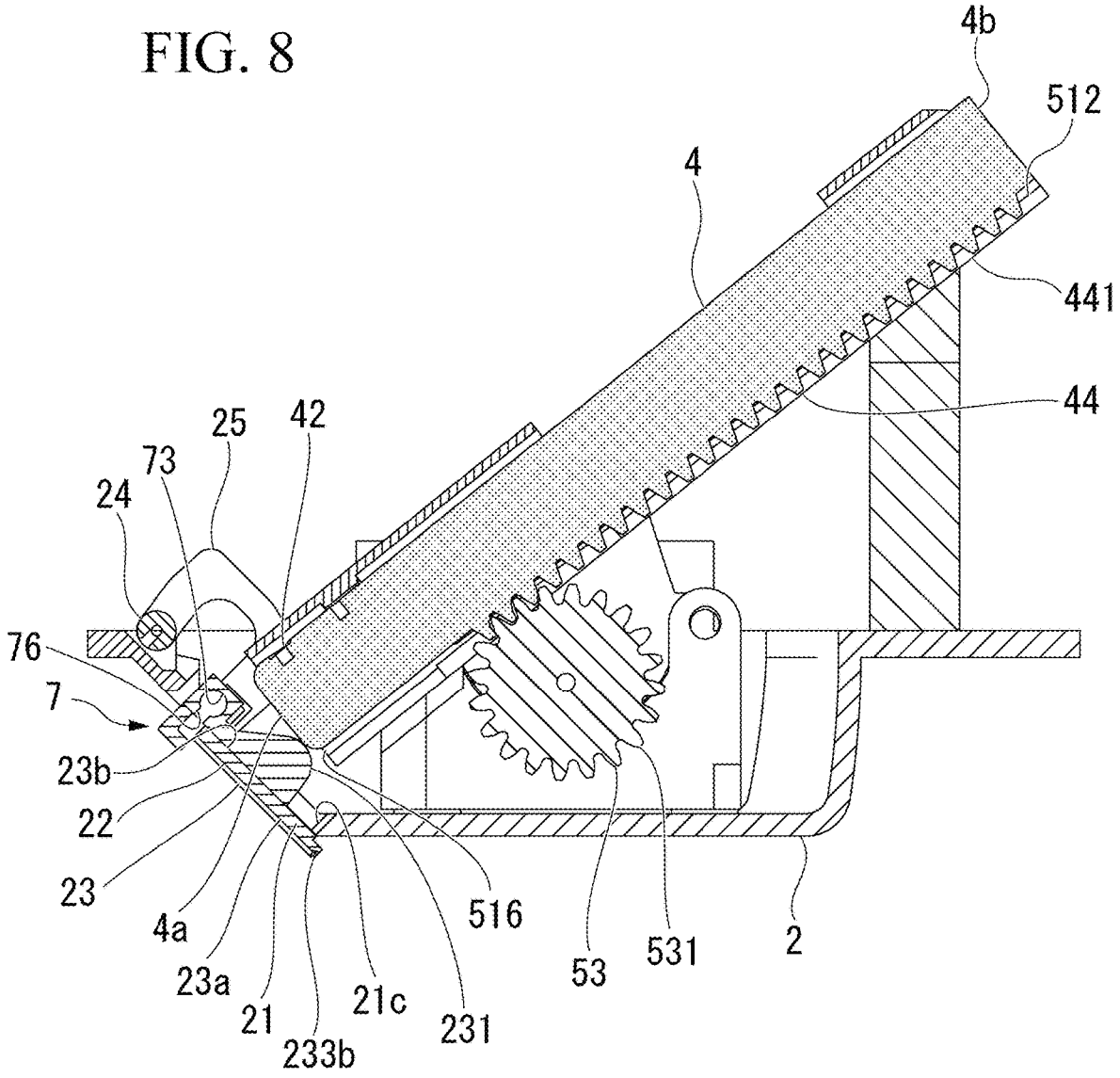
FIG. 8 is a cross-sectional view taken along line C-C of FIG. 2 according to some embodiments.
Figure 9:
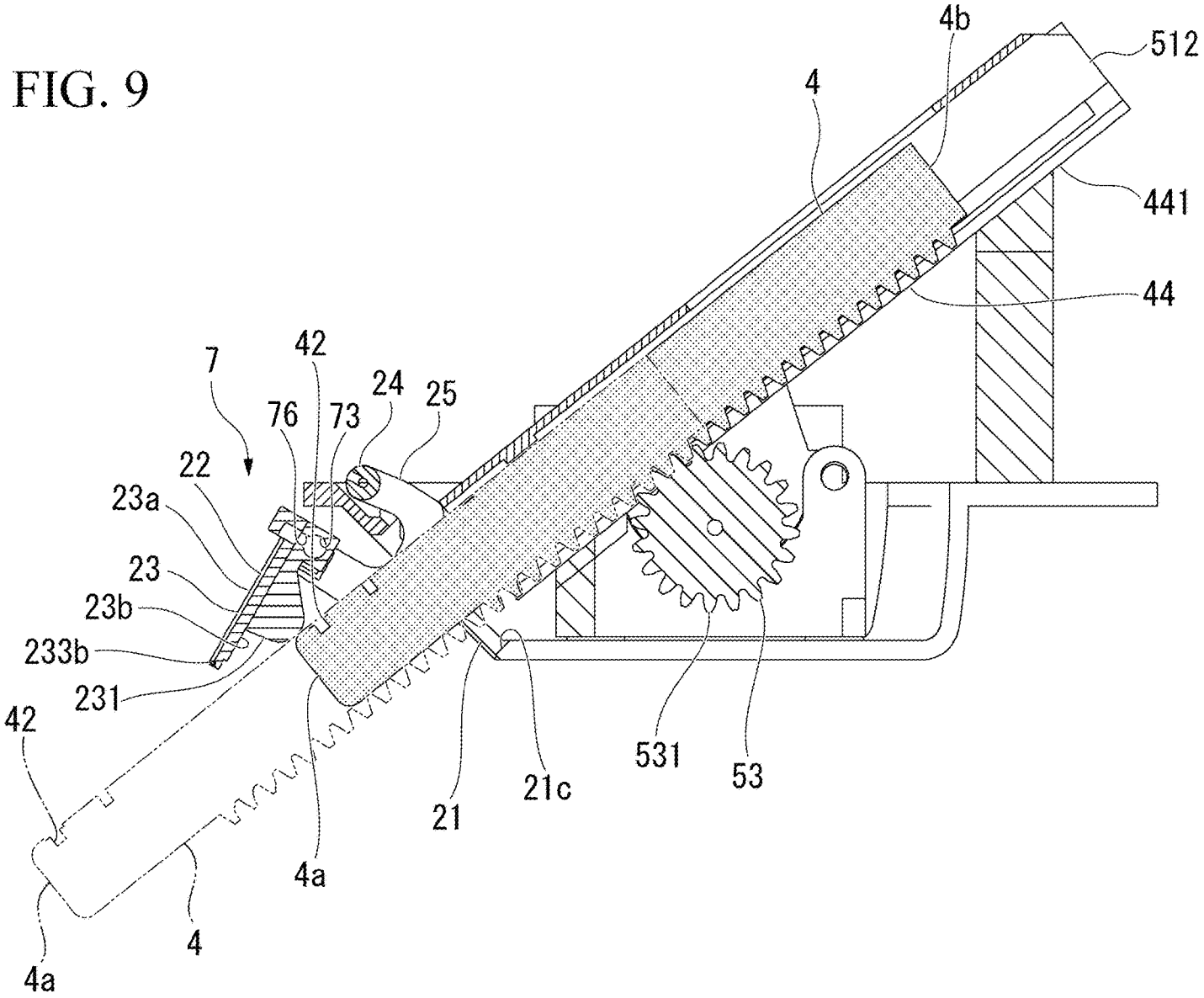
FIG. 9 is a cross-sectional view taken along line D-D of FIG. 3 according to some embodiments.
Figure 10:
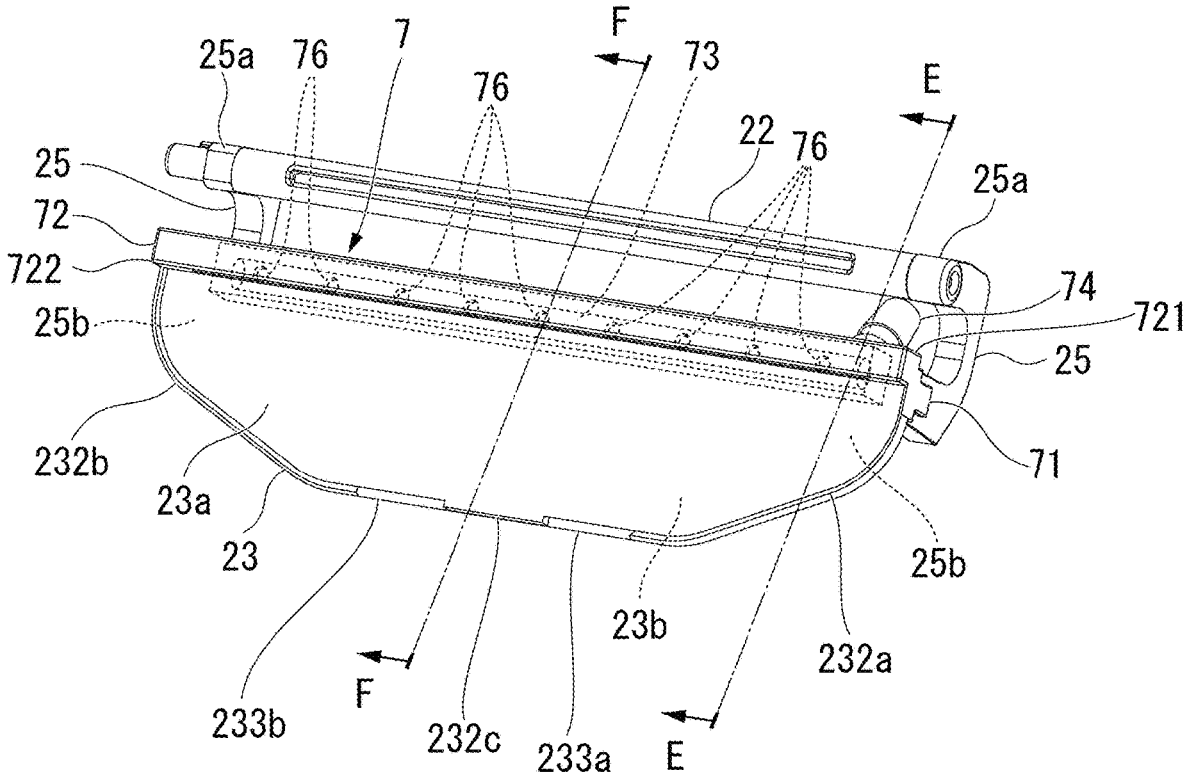
FIG. 10 is a perspective view of a shutter when viewed from the front according to some embodiments.
Figure 11:
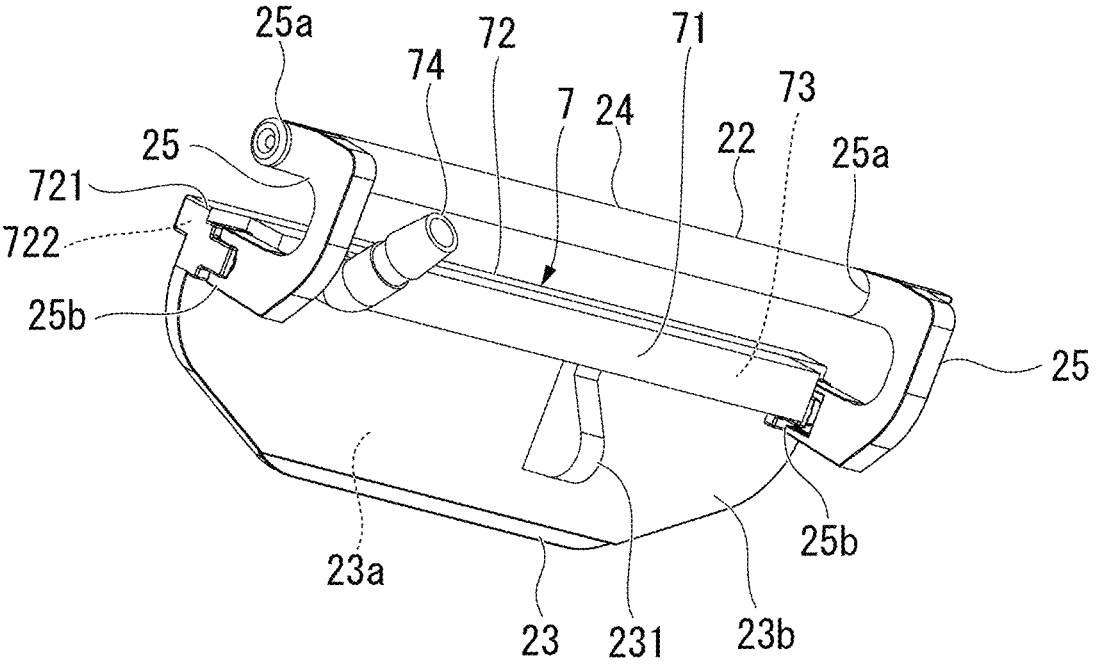
FIG. 11 is a perspective view of the shutter when viewed from the rear according to some embodiments.
Figure 12:
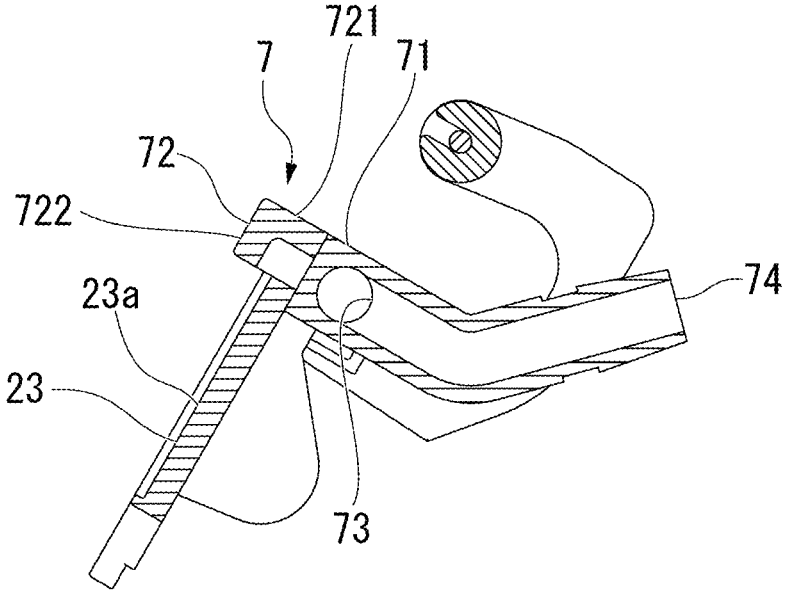
FIG. 12 is a cross-sectional view taken along line E-E of FIG. 10 according to some embodiments.
Figure 13:
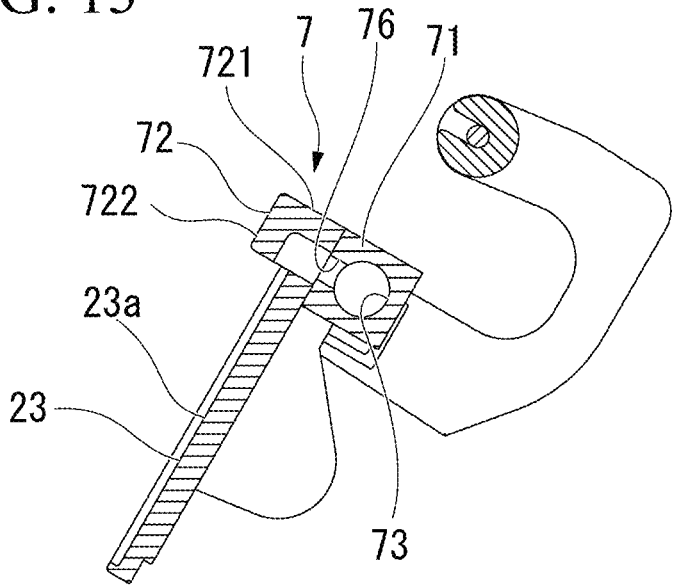
FIG. 13 is a cross-sectional view taken along line F-F of FIG. 10 according to some embodiments.
Figure 14:
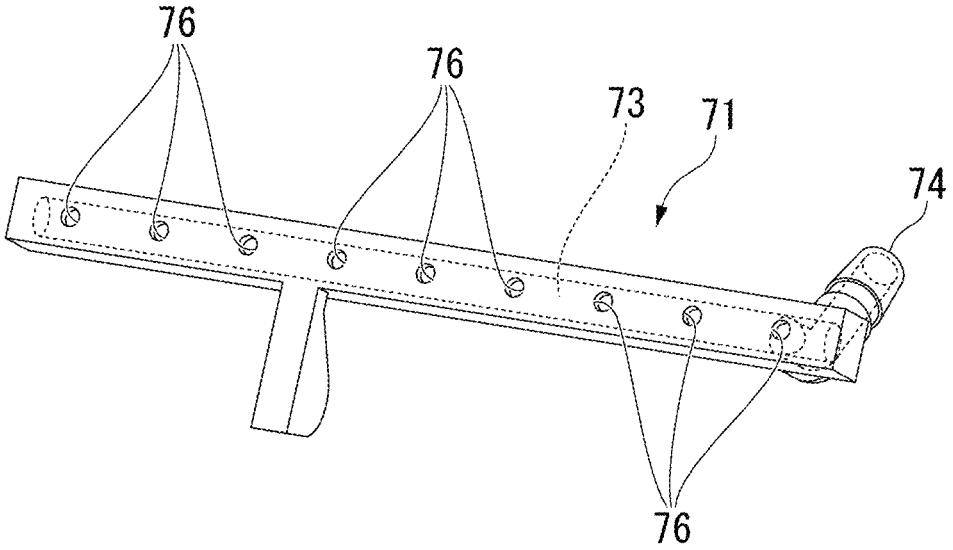
FIG. 14 is a perspective view of a water film formation water ejector according to some embodiments
Figure 15:
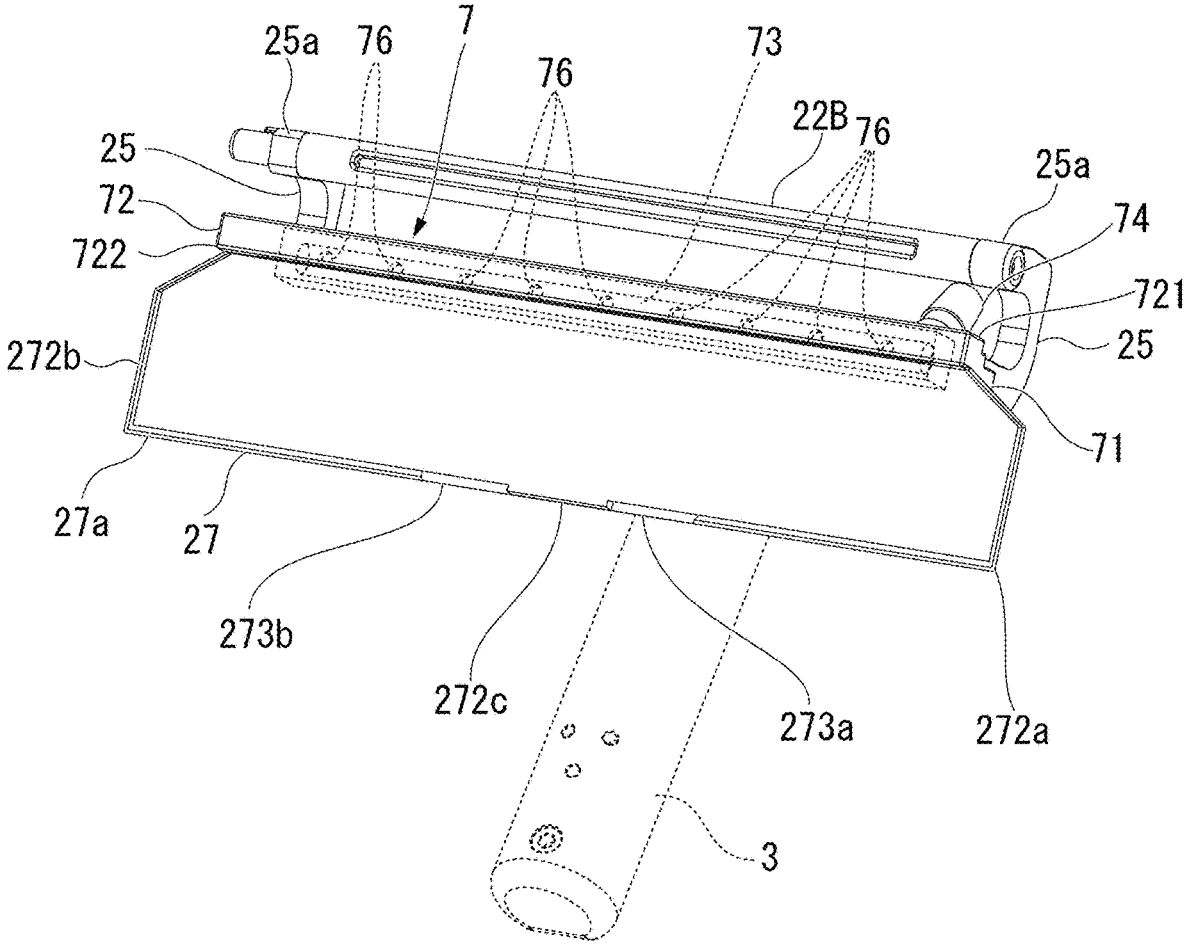
FIG. 15 is a perspective view of the shutter in a modified example when viewed from the front according to some embodiments.

As illustrated in FIGS. 8 and 9, a second rack 44 (a gear) is provided lower side of the second cleaning nozzle 4. The second rack 44 is provided in the length direction of the second cleaning nozzle 4. In the second rack 44, a plurality of teeth 441 protruding downward are arranged in the length direction of the second cleaning nozzle 4.

The second rack 44 is not provided in the vicinity of the front end part 4*a* of the second cleaning nozzle 4 and the second rack 44 is provided in a range from an intermediate part where is behind the front end part 3*a* with a slight distance in the length direction to the rear end part 4*b* in the second cleaning nozzle 4.

Figure 4:
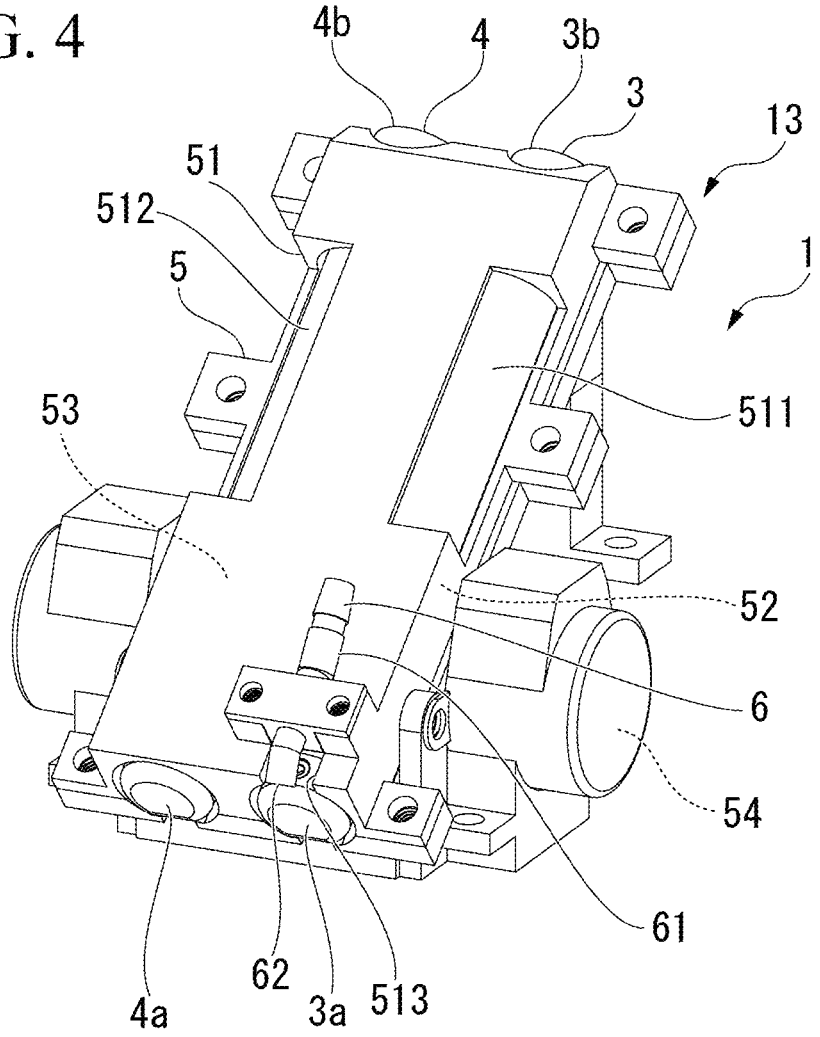
FIG. 4 is a perspective view in which the case of FIG. 2 is omitted according to some embodiments.

As illustrated in FIGS. 4 and 5, the supporter 5 supports the first cleaning nozzle 3 and the second cleaning nozzle 4 so that the first cleaning nozzle 3 and the second cleaning nozzle 4 are capable of advancing and retracting in the oblique direction forward and gradually downward. The direction in which the first cleaning nozzle 3 and the second cleaning nozzle 4 is advanced and retracted is referred to as a "cleaning nozzle advance-retract direction." The cleaning nozzle advance-retract direction is set in the same direction as the length direction of the first cleaning nozzle 3 and the second cleaning nozzle 4.

The supporter 5 includes a support main body 51, a first pinion 52, a second pinion 53, and a motor 54. The first cleaning nozzle 3 and the second cleaning nozzle 4 are moved into and outside of the support main body 51. The first pinion 52 constitutes a rack and pinion mechanism together with the first rack 34 which meshes with the first rack 34 (refer to FIGS. 6 and 7) of the first cleaning nozzle 3. The second pinion 53 constitutes a rack and pinion mechanism together with the second rack 44 which meshes with the second rack 44 (refer to FIGS. 8 and 9) of the second cleaning nozzle 4. The motor 54 rotationally drives the first pinion 52 and the second pinion 53.

The support main body 51 includes a first cleaning nozzle insertion part 511 and a second cleaning nozzle insertion part 512. The first cleaning nozzle insertion part 511 is configured such that the first cleaning nozzle 3 is capable of moving into and outside of the first cleaning nozzle insertion part 511. The second cleaning nozzle insertion part 512 is configured such that the second cleaning nozzle 4 is capable of moving into and outside of the second cleaning nozzle insertion part 512. The first cleaning nozzle insertion part 511 and the second cleaning nozzle insertion part 512 are provided in parallel.

The first cleaning nozzle insertion part 511 is an insertion hole through which the support main body 51 passes in the cleaning nozzle advance-retract direction. The first cleaning nozzle insertion part 511 is configured such that the first cleaning nozzle 3 is capable of being advanced and retracted through an opening 515 on the lower side and the front side (a front end side) in the cleaning nozzle advance-retract direction. In some embodiments, a notch part 513 is formed at an upper portion of the support main body 51 and at the vicinity of a lower and front end part (the front end part) of the first cleaning nozzle insertion part 511. The notch part 513 is opened at top part in lower side and front side (a front end) of the first cleaning nozzle insertion part 511. An upper surface of the first cleaning nozzle 3 inserted into the first cleaning nozzle insertion part 511 is exposed upward from the notch part 513.

The second cleaning nozzle insertion part 512 is an insertion hole which passes through the support main body 51 in the cleaning nozzle advance-retract direction. The second cleaning nozzle insertion part 512 is configured such that the second cleaning nozzle 4 is capable of being advanced and retracted through the opening 516 on the lower side and the front side (a front end side) in the cleaning nozzle advance-retract direction.

As illustrated in FIGS. 6 and 7, the first pinion 52 is formed in a disc shape and the teeth 521 are formed on the entire outer circumferential portion.

The first pinion 52 is arranged below the first rack 34 in a direction in which a rotation axis thereof extends in the width direction. The first pinion 52 is configured such that the teeth 521 in the outer circumferential portion thereof mesh with the teeth 341 of the first rack 34. The first pinion 52 is configured to be rotated around the rotation axis through the driving of the motor 54 (refer to FIGS. 4 and 5) and to move the first rack 34 in the oblique direction, that is, in an advance-retract direction of the first rack.

The second pinion 53 is formed in a disc shape and the teeth 531 are formed on the entire outer circumferential portion.

The second pinion 53 is arranged below the second rack 44 and in a direction in which a rotation axis thereof extends in the width direction. The second pinion 53 is configured such that the teeth 531 formed on the outer circumferential portion mesh with the teeth 441 of the second rack 44. The second pinion 53 is configured to be rotated around the rotation axis through the driving of the motor 54 (refer to FIGS. 4 and 5) and to move the second rack 44 in the oblique direction, that is, in the cleaning nozzle advance-retract direction.

As illustrated in FIGS. 4 to 7, the first cleaning nozzle water film forming portion 6 includes a water film formation water supply pipe 61 and a water film formation water supply portion (not shown). The water film formation water supply pipe 61 is a pipe through which water is supplied to the outer circumferential surface 39 (refer to FIG. 5) of the first cleaning nozzle 3. The water film formation water supply portion supplies water to the water film formation water supply pipe 61.

The water film formation water supply pipe 61 is installed on an upper portion of the support main body 51. A water film water ejection port 62 of the water film formation water supply pipe 61 is arranged above the notch part 513 formed in the support main body 51. The water film water ejection port 62 is arranged vertically above an axis of the first cleaning nozzle 3.

Water ejected through the water film water ejection port 62 is configured to drop onto an upper portion side 39*a* of an outer circumferential surface 39 above the axis of the first cleaning nozzle 3. The water film water ejection port 62 of the water film formation water supply pipe 61 is configured to be opened forward and downward and the water film water ejection port 62 is configured to eject water for forming a water film obliquely downward toward the front side and the lower side. The direction of water ejected through the water film water ejection port 62 intersects an advance-retract direction of the first cleaning nozzle 3 (the cleaning nozzle advance-retract direction or the length direction) at an acute angle.

The first cleaning nozzle water film forming portion 6 is controlled to eject water to the first cleaning nozzle 3 through the water film water ejection port 62 if the first cleaning nozzle 3 is in an advance state. In some embodiments, the first cleaning nozzle water film forming portion 6 is controlled to eject water to the outer circumferential surface 39 of the first cleaning nozzle 3 through the water film water ejection port 62 between a state in which the first cleaning nozzle 3 accommodated in the first cleaning nozzle insertion part 511 starts to be advanced from the first cleaning nozzle insertion part 511 and just before the advanced nozzle is retracted and is accommodated in the first cleaning nozzle insertion part 511.

When water is ejected to the first cleaning nozzle 3 through the water film water ejection port 62, the ejected water flows obliquely (obliquely downward) toward the front end surface 3*c* along the upper portion side 39*a* of the outer circumferential surface 39 of the first cleaning nozzle 3, water which has reached the front end surface 3*c* flows downward along the front end surface 3*c*, water flows from the upper portion side 39*a* side of the outer circumferential surface 39 of the first cleaning nozzle 3 to both sides in the width direction, and water flows to a lower portion side 39*b* of the outer circumferential surface 39 along the outer circumferential surface 39 is provided. Thus, an arrangement in which water ejected to the first cleaning nozzle 3 through the water film water ejection port 62 forms a water film on the outer circumferential surface 39 and the front end surface 3*c* of the first cleaning nozzle 3 is provided.

The water force of the water ejected through the water film water ejection port 62 and forming the water film around the cleaning water discharge outlet 32 of the first cleaning nozzle 3 is set to be weaker than the water force of warm water for private part cleaning ejected through the cleaning water discharge outlet 32 of the first cleaning nozzle 3.

The water force may refer to a force of water to be ejected or water to flow and is determined in accordance with an amount and a speed of water to be ejected or water to flow.

The control unit is configured to be capable of receiving a signal from an operation unit (not shown) to be operated by the user. The operation unit includes operation components such as buttons capable of starting and stopping anal cleaning, bidet cleaning, warm air drying, and the like and operating strength and weakness of anal cleaning, bidet cleaning, warm air drying, and the like.

The shutter 22 includes the shutter main body 23, a rotating shaft 24, and a pair of connection arms 25. The shutter main body 23 opens and closes the opening 21*c* from the front side. The rotating shaft 24 is supported by the case 2. The pair of connection arms 25 connect the shutter main body 23 with the rotating shaft 24. A water film formation water ejector 71 is attached to an upper part of the shutter main body 23 of the shutter 22. The water film formation water ejector 71 ejects water to the front surface 23*a* of the shutter main body 23.

As illustrated in FIGS. 2, 3, 10, and 11, the shutter main body 23 is slightly larger than the opening 21*c* (refer to FIG. 2) of the case 2 and is formed in a plate shape having a size to close the opening 21*c*. A plate surface of the shutter main body 23 has a shape in which a length thereof in a vertical direction is longer than a length thereof in a horizontal direction. The shutter main body 23 is arranged in a diagonal direction such that a horizontal direction of the shutter main body 23 is the width direction and a vertical direction thereof is directed in an upward-downward direction or an upper edge portion 23*c* in the vertical direction is on an upper side and a lower edge part 23*d* in the vertical direction is on a lower side. In the following description of the shutter 22, the upper edge portion 23*c* side of the shutter main body 23 in the vertical direction thereof is referred to as an "upper side" and the lower edge part 23*d* side is referred to as a "lower side".

When the opening 21*c* is closed, the shutter main body 23 and the front plate part 21 overlap and the plate surface of the shutter main body 23 is arranged to face substantially the same direction as the cleaning nozzle advance-retract direction.

In a surface of the shutter main body 23, a surface faces the inside of the toilet bowl 121 (refer to FIG. 1) when the opening 21*c* has been closed is referred to as the "front surface 23*a*" and a surface opposite to the front surface and faces the opening 21*c* is referred to as the "rear surface 23*b*."

The shutter main body 23 has a shape in which an upper edge portion 23*c* and a lower edge part 23*d* extend in the width direction, the lower edge part 23*d* is shorter than the upper edge portion 23*c*, and a dimension thereof in the width direction decreases from the upper side toward the lower side. An upper portion side of edge portions of the shutter main body 23 on both sides in the width direction thereof extends in the upward-downward direction and a lower portion side thereof gradually extends toward the inner side in the width direction toward the lower side in the oblique direction such that the lower portion side of the both sides in the width direction are in proximity to each other.

First, second, and third ribs (protrusion walls and guide parts) 232*a*, 232*b*, and 232*c* which protrude forward are provided on an outer edge portion of the shutter main body 23.

The first rib 232*a* is continuously provided to the entire side edge part of an outer edge part of the shutter main body 23 on a first outer edge side in the width direction and to a part of a lower edge where is vicinity of the first outer edge side in the width direction.

The second rib 232*b* is continuously provided to the entire side edge part of the outer edge part of the shutter main body 23 on a second outer edge side in the width direction and to a part of the lower edge where is vicinity of the second outer edge side in the width direction.

The third rib 232*c* is provided at an intermediate part of the outer edge part of the shutter main body 23 in the width direction of the lower edge part 23*d*.

The third rib 232*c* is provided between the first rib 232*a* and the second rib 232*b*. The third rib 232*c* is separated from the first rib 232*a* and the second rib 232*b* in the width direction.

A space between the first rib 232*a* and the third rib 232*c* is referred to as a "first notch part 233*a*" and a space between the second rib 232*b* and the third rib 232*c* is referred to as a "second notch part 233*b*".

The first notch part 233*a* is arranged at a position overlapping to the first cleaning nozzle 3 in the forward-rearward direction and the upward-downward direction. The second notch part 233*b* is arranged at a position overlapping to the second cleaning nozzle 4 in the forward-rearward direction and the upward-downward direction.

A rib is not provided on the upper edge portion of the outer edge portion of the shutter main body 23.

A protrusion 231 (refer to FIGS. 3 and 11) is formed at a position of the rear surface 23*b* of the shutter main body 23 which is closer to the second outer edge than a center in the width direction and faces the second cleaning nozzle 4. The protrusion 231 may be formed at a position of the rear surface 23*b* which faces the second cleaning nozzle 4.

The rotating shaft 24 is formed in a rod shape in which an axis thereof is a straight line and is arranged such that an axial direction thereof is directed in the width direction. The rotating shaft 24 is arranged on the rear side of the front plate part 21. On the rear side of the front plate part 21, both end portions of a rotary shaft 24 are supported by a shaft supporter 26 (refer to FIGS. 2 and 3) provided above the opening 21*c*. The rotating shaft 24 is configured to be rotatable around an axis which extends in the width direction while being supported by the shaft supporter 26.

Each of the pair of connection arms 25 has a substantially C shape. In the pair of connection arms 25, a first end part 25*a* of the C-shaped both end parts is connected to the rotating shaft 24 and a second end part 25*b* is connected to the upper edge portion of the shutter main body 23.

A first connection arm 25 of the pair of connection arms 25 is connected to the shutter main body 23 and the rotating shaft 24 at the vicinity of first end portions in the width direction thereof and a second connection arm 25 is connected to the shutter main body 23 and the rotating shaft 24 at the vicinity of second end portions of in the width direction thereof. The pair of connection arms 25 are arranged at positions in which the connection arms 25 are capable of being inserted inside the opening 21*c* through the rotation centering on the rotating shaft 24.

As illustrated in FIG. 2, in a state in which the shutter main body 23 closes the opening 21*c*, each of the pair of connection arms 25 is arranged on the rear side of the front plate part 21 (inside the case 2), the second end portion 25*b* on the shutter main body 23 side is arranged below and behind with respect to the first end portion 25*a* on the rotating shaft 24 side, and a C-shaped outer form is arranged in a direction to be open in an oblique direction facing the front side and the lower side.

From this state, if the shutter 22 rotates forward about the rotating shaft 24, as illustrated in FIG. 3, the second end portion 25*b* on the shutter main body 23 side is arranged the upper side and the front side with respect to the first end portion 25*a* of the pair of connection arms 25 on the rotating shaft 24 side, the C-shaped outer form is oriented to be opened in the oblique direction facing the front side and the upper side, and the shutter main body 23 has a state in which the shutter main body 23 is separated from the front plate part 21 and the opening 21*c* is opened.

In this state, an upper part of the opening 21*c* in the front plate part 21 is arranged inside each of the pair of connection arms 25, that is, inside the C-shaped outer form. In a state in which the shutter main body 23 is opened, the front surface 23*a* faces in the oblique direction such that the front surface 23*a* is on the front side and the upper side and the rear surface 23*b* faces in the oblique direction such that the rear surface 23*b* is on the rear side and the lower side.

The shutter 22 is biased so that a state in which the opening 21*c* is closed is maintained. For this reason, when an external force acts on the shutter 22 in a direction in which the opening 21*c* is opened, the shutter 22 rotates and opens the opening 21*c*. When the external force applied to the shutter 22 in the direction to open the opening 21*c* is released, the shutter 22 is restored to its original position and closes the opening 21*c*.

As illustrated in FIGS. 10 to 13, the shutter water film forming portion 7 includes the water film formation water ejector 71, a cover 72, and the water film formation water supply portion (not shown). The water film formation water ejector 71 is attached to the upper part of the shutter main body 23 and ejects water to the front surface 23*a* of the shutter main body 23. The cover 72 is provided on the front side of the water film formation water ejector 71. The water film formation water supply portion supplies water to the water film formation water ejector 71.

As illustrated in FIGS. 10 to 14, the water film formation water ejector 71 is a long member and is provided along the upper edge portion 23*c* of the shutter main body 23 so as to extend in the width direction. A water flowing portion 73 is formed inside the water film formation water ejector 71. A water flowing portion 72 is a hollow portion extending in a length direction and through which water flows. That is to say, a water flow direction of the water flowing portion 73 is a direction in the width direction. The water flowing portion 73 is formed such that the water flowing portion 73 does not pass through the water film formation water ejector 71 in the length direction.

The water supply port 74 is formed on a first end side of the water film formation water ejector 71 in the width direction thereof. The water supply port 74 communicates with the outside of the water flowing portion 73 and the water film formation water ejector 71. A water supply pipe of the water film formation water supply portion is connected to the water supply port 74. Water supplied from the water film formation water supply portion flows to the water flowing portion 73 through the water supply port 74. Water which has flowed to the water flowing portion 73 through the water supply port 74 flows from the first end side of the water flowing portion 73 in the width direction thereof, that is, a side close to the water supply port 74 toward a second end side, that is, a side to be away from the water supply port 74. In the water flowing portion 73, the first end side in the width direction is an upstream side in the water flow direction and the second end side in the width direction is a downstream side in the water flow direction.

A plurality of water ejection ports 76 which are opened toward the front side are formed in the water film formation water ejector 71 at positions spaced apart from each other in the length direction over the entire length of the water film formation water ejector 71. The plurality of water ejection ports 76 are arranged in the length direction of the water film formation water ejector 71 and communicate the inside of the water flowing portion 73 with the front of the water film formation water ejector 71. The plurality of water ejection ports 76 are arranged at intervals in the width direction. That is to say, the plurality of water ejection ports 76 are arranged at intervals in the water flow direction of the water flowing portion 73.

The plurality of water ejection ports 76 are arranged above the front surface 23*a* of the shutter main body 23. An arrangement in which water ejected through the plurality of water ejection ports 76 flows downward along the front surface 23*a* of the shutter main body 23 is provided.

The plurality of water ejection ports 76 are set such that an inner diameter of water ejection ports 76 connected to a downstream side of the water flowing portion 73 is gradually larger than an inner diameter of water ejection ports 76 connected to an upstream side of the water flowing portion 73.

The cover 72 includes an upper plate part 721 and a front plate part 722. The upper plate part 721 extends from the upper side toward the front side of the plurality of water ejection ports 76 in the water film formation water ejector 71. The front plate part 722 extends downward from a leading edge portion of the upper plate part 721. The front plate part 722 is arranged at a position in which the front plate part 722 and the plurality of water ejection ports 76 overlap in the forward-rearward direction, that is, in a direction in which the plurality of water ejection ports 76 are opened. Water ejected through the plurality of water ejection ports 76 flows downward through a gap between the water film formation water ejector 71 and the front plate part 722, flows to the front surface 23*a* of the shutter main body 23, and forms a water film on the front surface 23*a* of the shutter main body 23.

An operation when private part cleaning is performed by the private part cleaning device 1 according to some embodiments will be described below.

If the operation unit is operated and the control unit receives a signal for starting anal cleaning, as illustrated in FIG. 9, the second cleaning nozzle 4 is advanced toward the front side in the cleaning nozzle advance-retract direction. If the front end part 4*a* of the second cleaning nozzle 4 comes into contact with the protrusion 231 of the shutter 22 and is advanced further toward the front side, the shutter 22 is rotated and pushed up so that the shutter 22 opens the opening 21*c*. If the second cleaning nozzle 4 is at a position in which the shutter 22 is pushed up and the opening 21*c* is opened, further advance of the second cleaning nozzle 4 is stopped. At this time, the front end part 4*a* of the second cleaning nozzle 4 comes into contact with the protrusion 231 and the second cleaning nozzle 4 is arranged to the rear side from the front end part of the shutter main body 23.

Simultaneously with or slightly after the advance of the second cleaning nozzle 4, the first cleaning nozzle 3 is advanced toward the front side in the cleaning nozzle advance-retract direction. At this time, since the shutter 22 is in a state in which the opening 21*c* is opened, as illustrated in FIG. 7, the first cleaning nozzle 3 is advanced from the opening 21*c* of the case 2 and passes through the opening 21*c* without coming into contact with the shutter 22, the first cleaning nozzle 3 passes through under the shutter 22, and is advanced to a position at where the front end part 3*a* is positioned to the front side from the shutter 22.

The advanced first cleaning nozzle 3 is arranged under the rear surface 23*b* of the shutter main body 23 and the first cleaning nozzle 3 is separated from the rear surface 23*b* of the shutter main body 23 in the upward-downward direction. Furthermore, the first cleaning nozzle 3 is also separated from an edge portion of the opening 21*c*.

When the first cleaning nozzle 3 is advanced to the most front end, warm water for private part cleaning is ejected through the cleaning water discharge outlet 32 of the first cleaning nozzle 3 and an anal cleaning operation (a private part cleaning operation) is performed.

When a predetermined time elapsed after the anal cleaning operation is started or the control unit receives a signal for stopping the anal cleaning operation, the water ejection through the cleaning water discharge outlet 32 of the first cleaning nozzle 3 is terminated.

When the private part cleaning operation is terminated, the first cleaning nozzle 3 is retracted toward the rear side in the cleaning nozzle advance-retract direction and is accommodated in the first cleaning nozzle insertion part 511 of the supporter 5. When the first cleaning nozzle 3 is accommodated in the first cleaning nozzle insertion part 511, the second cleaning nozzle 4 is also retracted toward the rear side in the cleaning nozzle advance-retract direction and is accommodated in the second cleaning nozzle insertion part 512 of the supporter 5.

As described above, since the shutter 22 is biased to close the opening 21*c*, when the second cleaning nozzle 4 is retracted and an external force does not act on the shutter 22 in the direction to open the opening 21*c*, the shutter 22 rotates in the direction to close the opening 21*c* and closes the opening 21*c*.

During a time after the advance of the second cleaning nozzle 4 is started and the first cleaning nozzle 3 is also advanced and until the first cleaning nozzle 3 and the second cleaning nozzle 4 are retracted and are accommodated in each of the first cleaning nozzle insertion part 511 and the second cleaning nozzle insertion part 512 of the supporter 5, the shutter water film forming portion 7 is driven and water for forming a water film from the upper side of the front surface 23*a* is ejected from the plurality of water ejection ports 76 of the water film formation water ejector 71 toward the front surface 23*a* of the shutter main body 23.

The water ejected through the plurality of water ejection ports 76 flows downward through the gap between the water film formation water ejector 71 and the front plate part 722, flows from the upper side to the front surface 23*a* of the shutter main body 23, and flows downward along the front surface 23*a* of the shutter main body 23 to form a water film on the front surface 23*a* of the shutter main body 23.

The water flowing on the front surface 23*a* of the shutter main body 23 is guided downward through the first rib 232*a* and the second rib 232*b* even if the water flows outward from the shutter main body 23 in the width direction. For this reason, a water film is capable of being formed on the front surface 23*a* of the shutter main body 23.

The water flowing on the front surface 23*a* of the shutter main body 23 flows downward from the first notch part 233*a* and the second notch part 233*b* at the lower edge portion of the shutter main body 23. The third rib 232*c* protruding forward is provided between the first notch part 233*a* and the second notch part 233*b*. For this reason, the water flowing and coming above the third rib 232*c* moves in the width direction along the third rib 232*c* and flows downward from the first notch part 233*a* and the second notch part 233*b*.

The advanced first cleaning nozzle 3 (refer to FIG. 3) is arranged under the first notch part 233*a*. For this reason, the water which has flowed on the front surface 23*a* of the shutter main body 23 and reached the first notch part 233*a* flows into the first cleaning nozzle 3.

In some embodiments, the plurality of water ejection ports 76 are set such that the inner diameter of the water ejection ports 76 connected to the downstream side of the water flowing portion 73 becomes increasingly gradually larger than the inner diameter of the water ejection ports 76 connected to the upstream side of the water flowing portion 73. Since the inner diameter of the water ejection ports 76 on the downstream side is larger than the inner diameter of the water ejection ports 76 on the upstream side, even when the water pressure on the downstream side is smaller than that on the upstream side inside the water flowing portion 73, a flow rate from the water ejection ports 76 on the downstream side is capable of being adjusted to be substantially the same as a flow rate of the water ejection ports 76 on the upstream side.

During a time after the advance of the first cleaning nozzle 3 is started and until the first cleaning nozzle 3 is retracted and is accommodated in the first cleaning nozzle insertion part 511 of the supporter 5, as illustrated in FIG. 5, the first cleaning nozzle water film forming portion 6 is driven and water for forming a water film from the upper side of the outer circumferential surface 39 is ejected from the water film water ejection port 62 toward the upper portion side 39*a* of the outer circumferential surface 39 of the first cleaning nozzle 3.

The water which has ejected through the water film water ejection port 62 flows obliquely toward the front end surface 3*c* along the upper portion side 39*a* of the outer circumferential surface 39 of the first cleaning nozzle 3 and the water which has reached the front end surface 3*c* flows downward along the front end surface 3*c*, flows from the upper portion side 39*a* side of the outer circumferential surface 39 of the first cleaning nozzle 3 to both sides in the width direction, and flows toward the lower portion side of the outer circumferential surface 39 along the outer circumferential surface 39.

Furthermore, a water film is formed on the outer circumferential surface 39 and the front end surface 3*c* of the first cleaning nozzle 3 by the water which has been ejected to the first cleaning nozzle 3 through the water film water ejection port 62. In a state in which the first cleaning nozzle 3 is advanced to the most front end, the water ejected through the water film water ejection port 62 is supplied toward the upper side in the vicinity of the rear end part 3*b* of the first cleaning nozzle 3.

As described above, the water flowed on the front surface 23*a* of the shutter main body 23 by the shutter water film forming portion 7 flows from the first notch part 233*a* to the first cleaning nozzle 3. As a result, the water, which has formed a water film on the front surface 23*a* of the shutter main body 23 by the shutter water film forming portion 7, flown into the first cleaning nozzle 3 and the water ejected through the water film water ejection port 62 of the first cleaning nozzle water film forming portion 6 form a water film on the outer circumferential surface 39 and the front end surface 3*c* of the first cleaning nozzle 3.

As described above, the water force of the water, which is ejected through the water film water ejection port 62 and forms a water film around the cleaning water discharge outlet 32 of the first cleaning nozzle 3, is set to be weaker than the water force of warm water for private part cleaning ejected through the cleaning water discharge outlet 32 of the first cleaning nozzle 3. As a result, when the cleaning water is ejected from the first cleaning nozzle 3, warm water for private part cleaning ejected from the first cleaning nozzle 3 is capable of being prevented from being mixed with the water forming the water film.

The water force of the water, which has formed the water film on the front surface 23*a* of the shutter main body 23 through the shutter water film forming portion 7, is also set to be weaker than the water force of the warm water for private part cleaning ejected through the cleaning water discharge outlet 32 of the first cleaning nozzle 3. As a result, the water which has formed the water film on the front surface 23*a* of the shutter main body 23 through the shutter water film forming portion 7 is capable of being prevented from being mixed with the warm water for private part cleaning ejected from the first cleaning nozzle 3.

When the operation unit is operated and the control unit receives a signal for starting bidet cleaning, as illustrated in FIG. 9, the second cleaning nozzle 4 is advanced in the cleaning nozzle advance-retract direction. When the second cleaning nozzle 4 comes into contact with the protrusion 231 of the shutter 22 and then is further advanced, the second cleaning nozzle 4 pushes up the shutter 22 and the shutter 22 opens the opening 21*c*. When the second cleaning nozzle 4 is further advanced and reaches the most front end (a position indicated by an alternate long and two short dashed line in FIG. 9), warm water for private part cleaning is ejected through the cleaning water discharge outlet 42 of the second cleaning nozzle 4 and a bidet cleaning operation (a private part cleaning operation) is performed.

When a predetermined time elapses after the bidet cleaning operation is started or the control unit receives a signal for stopping the bidet cleaning, the ejection water through the cleaning water discharge outlet 42 of the second cleaning nozzle 4 is terminated.

When the bidet cleaning operation is terminated, the second cleaning nozzle 4 is retracted toward the rear side in the cleaning nozzle advance-retract direction and is accommodated in the second cleaning nozzle insertion part 512 of the supporter 5. As described above, the shutter 22 is biased so as to close the opening 21*c*. As a result, when the second cleaning nozzle 4 is retracted and an external force does not act on the shutter 22 in the direction of opening the opening 21*c*, the shutter 22 rotates in the direction in which the shutter 22 closes the opening 21*c* to close the opening 21*c*.

During a time after the advance of the second cleaning nozzle 4 is started and until the second cleaning nozzle 4 is retracted and is accommodated in the second cleaning nozzle insertion part 512 of the supporter 5, the shutter water film forming portion 7 is driven and water for forming a water film from the upper side to the front surface 23*a* is ejected from the plurality of water ejection ports 76 of the water film formation water ejector 71 toward the front surface 23*a* of the shutter main body 23. The driving of the shutter water film forming portion 7 is the same as the above-described driving until the first cleaning nozzle 3 is retracted and is accommodated in the first cleaning nozzle insertion part 511 of the supporter 5 from the start of the advance of the first cleaning nozzle 3.

The water, which has flowed on the front surface 23*a* of the shutter main body 23, flows downward from the first notch part 233*a* and the second notch part 233*b* of the lower edge portion of the shutter main body 23. Since the advanced second cleaning nozzle 4 is arranged under the second notch part 233*b*, the water, which has flowed on the front surface 23*a* of the shutter main body 23 and reached the second notch part 233*b*, flows into the second cleaning nozzle 4 (refer to FIG. 9). The water flowed into the second cleaning nozzle 4 flows downward along the second cleaning nozzle 4 to form a water film on the outer circumferential surface and the front end surface 4*c* of the second cleaning nozzle 4.

The private part cleaning device 1 according to some embodiments does not include a mechanism of directly supplying water to the second cleaning nozzle 4 to form a water film.

An action and an effect of the private part cleaning device some embodiments will be described below with reference to the drawings.

The private part cleaning device 1 according to some embodiments includes the shutter water film forming portion 7 configured to supply water to the front surface 23*a* of the shutter main body 23 to form a water film. With such an arrangement, the front surface 23*a* of the shutter main body 23 is capable of being cleaned by the water film formed on the front surface 23*a* of the shutter main body 23 and it is capable of preventing contaminants from adhering to the front surface 23*a* of the shutter main body 23.

The plurality of water ejection ports 76 of the shutter water film forming portion 7 are arranged at intervals along the upper edge portion of the front surface 23*a* of the shutter main body 23. Thus, the water which has been ejected through the plurality of water ejection ports 76 is capable of flowing along the entire front surface 23*a* of the shutter main body 23 and is capable of forming a water film over the entire front surface 23*a* of the shutter main body 23. As a result, the private part cleaning device 1 capable of cleaning the entire front surface 23*a* of the shutter main body 23 and capable of preventing contaminants from adhering to the entire front surface 23*a* of the shutter main body 23.

The plurality of water ejection ports 76 of the shutter water film forming portion 7 are set such that the inner diameter of the water ejection ports 76 connected to the downstream side of the water flowing portion 73 becomes increasingly gradually larger than the inner diameter of the water ejection ports 76 connected to the upstream side of the water flowing portion 73. Thus, it is capable of securing a flow rate of the water to be ejected through the water ejection ports 76 located on the downstream side of the water flowing portion 73 and which are lower water pressure, the flow rate of the water to be ejected through each of the plurality of water ejection ports 76 is capable of being kept uniform, and a uniform water film is capable of being formed over the entire front surface 23*a* of the shutter main body 23.

The first rib 232*a*, the second rib 232*b*, and the third rib 232*c* which protrude forward are formed on an outer edge portion of the front surface 23*a* of the shutter main body 23. Thus, the water, which has been supplied from the shutter water film forming portion 7 to the front surface 23*a* of the shutter main body 23, hits the first rib 232*a*, the second rib 232*b*, and the third rib 232*c*. For this reason, before the water flows below the front surface 23*a* of the shutter main body 23, the water is prevented from flowing out from an edge portion of the shutter main body 23 to the outside and the water is reliably guided below the front surface 23*a* of the shutter main body 23. As a result, a water film is capable of being formed on the front surface 23*a* of the shutter main body 23.

In the private part cleaning device 1 according to some embodiments, the shutter water film forming portion 7 supplies water to the front surface 23*a* of the shutter main body 23 until the first cleaning nozzle 3 is also advanced after the advance of the second cleaning nozzle 4 is started and the advanced first cleaning nozzle 3 and second cleaning nozzle 4 are retracted and are accommodated in the first cleaning nozzle insertion part 511 and the second cleaning nozzle insertion part 512 of the supporter 5, and until the second cleaning nozzle 4 is retracted and is accommodated in the second cleaning nozzle insertion part 512 of the supporter 5 after the advance of the second cleaning nozzle 4 is started. Thus, a water film is formed on the front surface 23*a* of the shutter main body 23 at the time of using the toilet 11 in which the first cleaning nozzle 3 or the second cleaning nozzle 4 is advanced. Furthermore, it is capable of preventing sewage and filth from adhering to the front surface 23*a* of the shutter main body 23 at the time of using the toilet 11 by a water film formed on the front surface 23*a* of the shutter main body 23.

A water film is capable of being formed on the front surface 23*a* of the shutter main body 23 during a time performing private part cleaning by the first cleaning nozzle 3 or the second cleaning nozzle 4. For this reason, even if cleaning water for private part cleaning comes into contact with the user or the toilet bowl 121 (refer to FIG. 1) of the toilet 11 and splashes toward the front surface 23*a* of the shutter main body 23, the splashed cleaning water is capable of being prevented from adhering to the front surface 23*a* of the shutter main body 23 by a water film formed on the front surface 23*a* of the shutter main body 23.

In the private part cleaning device 1 according to some embodiments, the shutter water film forming portion 7 supplies water to the front surface 23*a* of the shutter main body 23 to form a water film. Thus, the private part cleaning device 1 capable of cleaning the front surface 23*a* of the shutter main body 23 by a water film formed on the front surface 23*a* of the shutter main body 23 and capable of preventing contaminants from adhering to the front surface 23*a* of the shutter main body 23.

The water, which has been supplied to the front surface 23*a* of the shutter main body 23 and has formed the water film on the front surface 23*a* of the shutter main body 23, flows to the first cleaning nozzle 3 or the second cleaning nozzle 4 to form a water film on the first cleaning nozzle 3 or the second cleaning nozzle 4. As a result, the first cleaning nozzle 3 and the second cleaning nozzle 4 are capable of being cleaned and it is capable of being preventing contaminants from adhering to the first cleaning nozzle 3 and the second cleaning nozzle 4.

The first rib 232*a*, the second rib 232*b*, the third rib 232*c* which protrude forward and the first and second notch parts 233*a* and 233*b* are formed on the outer edge portion of the front surface 23*a* of the shutter main body 23. Thus, the water which has formed the water film on the front surface 23*a* of the shutter main body 23 is capable of flowing from the first and second notch parts 233*a* and 233*b* into the first cleaning nozzle 3 and the second cleaning nozzle 4 along the first rib 232*a*, the second rib 232*b*, and the third rib 232*c*.

Although some embodiments of the private part cleaning device the present disclosure have been described above, the present disclosure is not limited to the embodiments described herein and can be appropriately modified without departing from the teachings of the present disclosure.

For example, although the plurality of water ejection ports 76 of the shutter water film forming portion 7 are arranged at intervals in the width direction along the upper edge portion of the front surface 23*a* of the shutter main body 23 in some embodiments, the number and position of the water ejection ports 76 may be set appropriately. For example, only one water ejection port may be provided or only one provided water ejection port may be formed in a slit shape.

Although the plurality of water ejection ports 76 of the shutter water film forming portion 7 are set such that the inner diameter of the water ejection ports 76 connected to the downstream side of the water flowing portion 73 becomes increasingly gradually larger than the inner diameter of the water ejection ports 76 connected to the upstream side of the water flowing portion 73 in the above-described embodiments, such an arrangement is, in some embodiments, not essential and the inner diameter of the water ejection ports 76 may be set appropriately.

Although the first rib 232*a*, the second rib 232*b*, and the third rib 232*c* which protrude forward and the first notch part 233*a* and the second notch part 233*b* are formed on the outer edge portion of the front surface 23*a* of the shutter main body 23 in the some embodiments, the first rib 232*a*, the second rib 232*b*, the third rib 232*c*, the first notch part 233*a*, and the second notch part 233*b* may not be formed.

Only the ribs which protrude forward are formed on the outer edge portion of the front surface 23*a* of the shutter main body 23 and the notch parts may not be formed. Furthermore, when the ribs which protrude forward and the notch parts are formed on the outer edge portion of the front surface 23*a* of the shutter main body 23, the number and position of the notch parts may be set appropriately.

In the above-described embodiments, an arrangement in which the water forming the water film on the front surface 23*a* of the shutter main body 23 flows into the first cleaning nozzle 3 and the second cleaning nozzle 4 and a water film is formed on the surfaces of the first cleaning nozzle 3 and the second cleaning nozzle 4 is provided. However, the private part cleaning device may be configured such that the water forming a water film on the front surface 23*a* of the shutter main body 23 does not flow into the first cleaning nozzle 3 and the second cleaning nozzle 4. For example, an arrangement in which the above-described ribs are provided at the positions on the front side and the upper side of the first cleaning nozzle 3 and the second cleaning nozzle 4, the notch parts may be provided at the positions separated from the first cleaning nozzle 3 and the second cleaning nozzle 4, and the water flows from the notch parts may be provided.

Although the shutter water film forming portion 7 forms a water film on the entire front surface 23*a* of the shutter main body 23 in some embodiments, a water film may be partially formed on the front surface 23*a* of the shutter main body 23.

For example, the shutter water film forming portion 7 may form a water film on the rear surface 23*b* of the shutter main body 23 or the front surface 23*a* and the rear surface 23*b* of the shutter main body 23. The shutter water film forming portion 7 may partially form a water film on the rear surface 23*b* of the shutter main body 23 or the front surface 23*a* and the rear surface 23*b* of the shutter main body 23 instead of the entire surface.

In some embodiments, the shutter water film forming portion 7 is configured to be driven to form a water film on the front surface 23*a* of the shutter main body 23 during a time from being advanced the first cleaning nozzle 3 after the advance of the second cleaning nozzle 4 is started and until retracting the advanced first and second cleaning nozzle 3 and 4 to be accommodated in each of the first cleaning nozzle insertion part 511 and the second cleaning nozzle insertion part 512 of the supporter 5. On the other hand, a period of driving the shutter water film forming portion 7 and forming a water film on the front surface 23*a* of the shutter main body 23 may be set appropriately. For example, the shutter water film forming portion 7 may be driven to form a water film on the front surface 23*a* of the shutter main body 23 in a time of using the first cleaning nozzle 3 and the second cleaning nozzle 4 or in a time of accommodating the advanced cleaning nozzle 3 and second cleaning nozzle 4 in the first cleaning nozzle insertion part 511 and the second cleaning nozzle insertion part 512.

A detection unit 8 (refer to FIG. 1) capable of detecting a user of the toilet 11 may be configured to be provided, and the shutter water film forming portion 7 may be configured to perform supplying water to the front surface 23*a* of the shutter 22 to form a water film when the detection unit 8 detects the user regardless of whether the first cleaning nozzle 3 and the second cleaning nozzle 4 is advanced or retracted.

In such a case, the detection unit 8 is a sensor capable of detecting a user who has entered a rest room including the toilet 11, a water supply room including a toilet, a washroom, and the like, or a predetermined region in the vicinity of the toilet 11. The shutter water film forming portion 7 may be configured to perform supplying water to the front surface 23*a* of the shutter 22 to form a water film when the detection unit 8 detects the user.

The detection unit 8 may be a sensor capable of detecting a sitting state of a user who sits on the toilet seat 14 of the toilet 11. The shutter water film forming portion 7 may be configured to perform supplying water to the front surface 23*a* of the shutter 22 to form a water film when the detection unit 8 detects the sitting state of the user.

The detection unit 8 may be a sensor capable of detecting a standing state of a user who stands on the front side of the toilet 11. The shutter water film forming portion 7 may be configured to perform supplying water to the front surface 23*a* of the shutter 22 to form a water film when the detection unit 8 detects the standing state of the user.

The shutter water film forming portion 7 may be configured to perform supplying water to the front surface 23*a* of the shutter 22 to form a water film during a period from when the detection unit 8 detects the user to when the detection unit 8 no longer detects the user and may be configured to supply water to the front surface 23*a* of the shutter 22 to form a water film until a certain period elapsed after the detection unit 8 detects the user.

In a case that the private part cleaning operation is performed by the first cleaning nozzle 3 or the second cleaning nozzle 4 while the shutter water film forming portion 7 supplying water to the front surface 23*a* of the shutter 22 to form a water film in accordance with a detection of the user by the detector 8, the shutter water film forming portion 7 may be configured to perform supplying water to the front surface 23*a* of the shutter 22 to form a water film during a time from advancing the first cleaning nozzle 3 and the second cleaning nozzle 4 after the detector 8 detects the user until the advanced first and second cleaning nozzles 3 and 4, which have performed private part cleaning, retracted, and the shutter 22 closes the opening 21*c*.

The shutter water film forming portion 7 may be configured to perform supplying water to form a water film on the front surface 23*a* of the shutter main body 23 until a predetermined time elapses after the shutter 22 closes the opening 21*c*.

In the above-described embodiments, the protrusion 231 is formed on the rear surface of the shutter main body 23 and the second cleaning nozzle 4 is configured to come into contact with the protrusion 231 and push up the shutter 22 so that the opening 21*c* is opened. However, an arrangement in which the protrusion provided on the second cleaning nozzle 4 comes into contact with the shutter main body 23 and pushes up the shutter main body 23 to open the opening 21*c* without forming the protrusion 231 on the shutter main body 23 may be provided.

An arrangement in which a link mechanism for pushing up the shutter main body 23 is provided and the link mechanism operates by the advance and retract of the second cleaning nozzle 4 to rotate the shutter 22 may be provided.

In the some embodiments, the shutter 22 is opened and closed in accordance with the advance and retract of the second cleaning nozzle 4. The shutter 22 may be configured to be opened and closed in accordance with the advance and retract of the first cleaning nozzle 3.

For example, an arrangement in which a protrusion is provided at a position on a rear side surface of the shutter main body 23 so as to face the first cleaning nozzle 3 and the first cleaning nozzle 3 may push or may be away from the protrusion by advancing and retracting so that the shutter 22 is opened and closed. An arrangement in which the protrusion protruding from the outer circumferential surface 39 may be provided on the first cleaning nozzle 3 and the protrusion of the first cleaning nozzle 3 may push up or may be away from the shutter main body 23 by being advanced and retracted the first cleaning nozzle 3 so that the shutter 22 is opened and closed.

Also in such a case, the outer circumferential surface 39 of the first cleaning nozzle 3 does not come into contact with the shutter main body 23 and the shutter main body 23 does not interfere with the water film formed on the outer circumferential surface 39 of the first cleaning nozzle 3.

The private part cleaning device 1 may include the motor or the like for opening and closing the shutter and the shutter 22 may be opened and closed through the driving of the motor regardless of whether the first cleaning nozzle 3 or the second cleaning nozzle 4 is advanced and retracted.

In some embodiments, an advance-retract mechanism of the first cleaning nozzle 3 and the second cleaning nozzle 4 is constituted of linear racks 34 and 44 provided lower side of the first cleaning nozzle 3 and the second cleaning nozzle 4 and pinions 52 and 53 provided below the racks 34 and 44. On the other hand, the advance-retract mechanism of the first cleaning nozzle 3 and the second cleaning nozzle 4 may be configured such that belt-like racks connected to the first cleaning nozzle 3 and the second cleaning nozzle 4 are wound around and unwound on the pinions to advance and retract the first cleaning nozzle 3 and the second cleaning nozzle 4.

The first cleaning nozzle water film forming portion 6 configured to form a water film on the outer circumferential surface 39 and the front end surface 3*c* of the first cleaning nozzle 3 is provided in the private part cleaning device 1 according to some embodiments. The first cleaning nozzle water film forming portion 6 may not be provided. A mechanism configured to form a water film on the outer circumferential surface of the second cleaning nozzle 4 may be provided.

All or a part of a process performed by the control unit of the private part cleaning device 1 in some embodiments may be realized by using a computer. In this case, a program for realizing this function may be recorded in a computer-readable recording medium and a program recorded in the recording medium may be read in a computer system, executed, and realized. The "computer system" mentioned herein includes an operating system (OS) and hardware such as peripheral devices. Furthermore, the "computer-readable recording medium" refers to a portable medium such as a flexible disk, a magneto-optical disk, a read only memory (ROM), and a compact disk (CD)-ROM and a storage device such as a hard disk built in a computer system. In addition, the "computer-readable recording medium" may include a medium configured to dynamically retain a program for a short period of time such as a communication line when a program is transmitted via a network such as the Internet and a communication circuit such as a telephone circuit and a medium configured to retain a program for a certain period of time such as a volatile memory inside a computer system which serves as a server or a client in this case. Moreover, the above-described program may be for realizing some of the functions described above, the above-described program may be a program which can realize the functions described above in combination with a program already recorded in a computer system, and the above-described program may be realized using a programmable logic device such as a field programmable gate array (FPGA).

Although some embodiments of the present disclosure have been described in detail above with reference to the drawings, the embodiments are not limited to the description herein and may also include design modifications and the like without departing from the teachings of the present disclosure. Furthermore, the constituent elements illustrated in each of the above-described embodiments and each modification can be appropriately combined and constituted.

It is possible to provide a private part cleaning device capable of cleaning a shutter.

What is claimed is:

1. A private part cleaning device, comprising:

a cleaning nozzle configured to be capable of being advanced and retracted and configured to perform cleaning a private part of a human body in an advanced state;

a shutter configured to open and close an opening through which the cleaning nozzle is advanced and retracted; and a water film forming portion supplying water to a front surface of the shutter to form a water film.

2. The private part cleaning device of claim 1, wherein the water film forming portion has a plurality of water ejection ports through which water is ejected to the front surface of the shutter, and the plurality of water ejection ports are arranged at intervals along an upper edge portion of the front surface of the shutter.

3. The private part cleaning device of claim 2, wherein the water film forming portion has a water flowing portion in which water flowing toward the plurality of water ejection ports flows and which is connected to each of the plurality of water ejection ports, the plurality of water ejection ports are arranged at intervals in a water flow direction of the water flowing portion, and the plurality of water ejection ports are set such that an inner diameter of the water ejection ports arranged on a downstream side becomes increasingly gradually larger than an inner diameter of the water ejection ports arranged on an upstream side.

4. The private part cleaning device of claim 1, wherein a protrusion wall protruding forward is formed on an outer edge portion of the front surface of the shutter.

5. The private part cleaning device of claim 1, wherein the water film forming portion is configured to supply water to the shutter when a user uses a toilet.

6. The private part cleaning device of claim 1, wherein the water film forming portion is configured to supply water to the shutter in a state in which the cleaning nozzle is advanced.

7. The private part cleaning device of claim 6, wherein the water film forming portion is configured to supply water to the shutter during a time in which the cleaning nozzle is advanced and performs a private part cleaning operation.

8. The private part cleaning device of claim 6, wherein the water film forming portion is configured to supply water to the shutter also after the advanced cleaning nozzle is retracted to a rearward of the opening.

9. The private part cleaning device of claim 5, comprising:

a detection unit capable of detecting a user of the toilet, wherein the water film forming portion is configured to supply water to the shutter when the detection unit detects the user.

10. The private part cleaning device of claim 9, wherein the detection unit is capable of detecting the user who has entered a region in which the toilet is provided, and the water film forming portion is configured to supply water to the shutter when the detection unit detects the user.

11. The private part cleaning device of claim 9, wherein the detection unit is capable of detecting a sitting state of the user who sits on a toilet seat of the toilet, and the water film forming portion is configured to supply water to the shutter when the detection unit detects the sitting state of the user.

12. The private part cleaning device of claim 1, wherein the detection unit is capable of detecting a standing state of the user who stands on a front side of the toilet, and the water film forming portion is configured to supply water to the shutter when the detection unit detects the standing state of the user.

13. The private part cleaning device of claim 9, wherein the water film forming portion is configured to supply water to the shutter until the cleaning nozzle is advanced and performs a private part cleaning operation, the cleaning nozzle terminated the private part cleaning operation is retracted, and the shutter is configured to close the opening after the detection unit detects the user.

14. The private part cleaning device of claim 1, wherein the water film forming portion is configured to supply water to the shutter and flow the water supplied to the shutter into the cleaning nozzle.

15. The private part cleaning device of claim 14, comprising:

a guide portion configured to guide the water supplied to the shutter into the cleaning nozzle.

16. The private part cleaning device of claim 15, wherein the guide portion is a protrusion wall protruding from a surface of the shutter to which water is supplied from the water film forming portion, and the protrusion wall is formed on an outer edge portion of the surface to which the water is supplied from the water film forming portion and is notched on an upper side of the cleaning nozzle.

17. A toilet which includes a private part cleaning device, wherein the private part cleaning device includes: a cleaning nozzle configured to be capable of being advanced and retracted through an opening and perform private part cleaning on a human body in a state in which the cleaning nozzle is advanced through the opening;

a shutter configured to open and close the opening; and a water film forming portion configured to supply water to the shutter to form a water film, wherein the water film forming portion is configured to supply water to the shutter when a user uses the toilet.

18. The private part cleaning device of claim 17, wherein the water film forming portion has a plurality of water ejection ports through which water is ejected to a front surface of the shutter, and the plurality of water ejection ports are arranged at intervals along an upper edge portion of the front surface of the shutter.

19. The private part cleaning device of claim 18, wherein the water film forming portion has a water flowing portion in which water flowing toward the plurality of water ejection ports flows and which is connected to each of the plurality of water ejection ports, the plurality of water ejection ports are arranged at intervals in a water flow direction of the water flowing portion, and the plurality of water ejection ports are set such that an inner diameter of the water ejection ports arranged on a downstream side becomes increasingly gradually larger than an inner diameter of the water ejection ports arranged on an upstream side.

20. The private part cleaning device of claim 17, wherein a protrusion wall protruding forward is formed on an outer edge portion of a front surface of the shutter.

* * * * *